US009617717B2

(12) United States Patent
Kondo et al.

(10) Patent No.: US 9,617,717 B2
(45) Date of Patent: Apr. 11, 2017

(54) CONSTRUCTION MACHINE CONTROL SYSTEM AND CONSTRUCTION MACHINE CONTROL METHOD

(71) Applicant: Komatsu Ltd., Tokyo (JP)

(72) Inventors: Shunichiro Kondo, Hiratsuka (JP); Daiki Arimatsu, Hiratsuka (JP); Yoshiki Kami, Hadano (JP); Yasuo Kanemitsu, Hiratsuka (JP); Yuki Shimano, Suita (JP); Yuto Fujii, Takatsuki (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/890,500

(22) PCT Filed: Jun. 29, 2015

(86) PCT No.: PCT/JP2015/068738

§ 371 (c)(1),
(2) Date: Nov. 11, 2015

(87) PCT Pub. No.: WO2015/186845

PCT Pub. Date: Dec. 10, 2015

(65) Prior Publication Data

US 2016/0376772 A1 Dec. 29, 2016

(51) Int. Cl.

| | |
|---|---|
| ***G06F 11/30*** | (2006.01) |
| ***E02F 9/26*** | (2006.01) |
| *E02F 3/32* | (2006.01) |

(52) U.S. Cl.

CPC ..... *E02F 9/264* (2013.01); *E02F 3/32* (2013.01)

(58) Field of Classification Search

CPC ..... E02F 9/26; E02F 9/264; B60C 23/0416

(Continued)

(56) References Cited

U.S. PATENT DOCUMENTS

| | | | | |
|---|---|---|---|---|
| 7,831,362 | B2 * | 11/2010 | Ishibashi | E02F 9/2045 37/341 |
| 2015/0330060 | A1 * | 11/2015 | Seki | E02F 9/264 701/33.1 |
| 2016/0251835 | A1 * | 9/2016 | Kitajima | E02F 3/3663 701/50 |

FOREIGN PATENT DOCUMENTS

| | | | |
|---|---|---|---|
| JP | 09-178481 | A | 7/1997 |
| JP | 2004-125580 | A | 4/2004 |

(Continued)

OTHER PUBLICATIONS

International Search Report and Written Opinion mailed Sep. 15, 2015, issued for PCT/JP2015/068738.

*Primary Examiner* — Thomas G Black
*Assistant Examiner* — Luke Huynh
(74) *Attorney, Agent, or Firm* — Locke Lord LLP

(57) ABSTRACT

A construction machine control system controls a construction machine including a traveling device, a work machine having a working tool, and a swing structure to which the work machine is attached and which is attached to the traveling device to swing with respect to the traveling device. The construction machine control system includes a position detection device that detects a first position which is a position of a partial portion of the construction machine and outputs the first position as first position information; a state detection device that detects and outputs operation information indicating an operation of the construction machine; and a processing device that calculates a second position corresponding to the position of the partial portion using the first position information and the operation information and calculates a position of at least a partial portion of the work machine using second position information.

6 Claims, 14 Drawing Sheets

(58) Field of Classification Search
USPC ..... 701/34.4, 50, 32.9, 33.1
See application file for complete search history.

(56) References Cited

FOREIGN PATENT DOCUMENTS

| | | | |
|---|---|---|---|
| JP | 2007-147588 | A | 6/2007 |
| JP | 2014-205955 | A | 10/2014 |

* cited by examiner

44

| OPERATION STATE \ POSITIONING STATE | STATE A | STATE B | STATE C |
|---|---|---|---|
| STATIONARY 1 | EQUATION (20)<br>EQUATION (22)<br>EQUATION (23)<br>EQUATION (24) | EQUATION (22)<br>EQUATION (23) | EQUATION (22)<br>EQUATION (23) |
| STATIONARY 2 | EQUATION (20)<br>EQUATION (22) | EQUATION (22) | EQUATION (22) |
| TRAVELING | EQUATION (20)<br>EQUATION (22)<br>EQUATION (24) | EQUATION (21) | NO CORRECTION |

CONSTRUCTION MACHINE CONTROL SYSTEM AND CONSTRUCTION MACHINE CONTROL METHOD

FIELD

The present invention relates to a construction machine control system used in a construction machine having a work machine and a construction machine.

BACKGROUND

A technique of measuring a three-dimensional position of a construction machine using a global positioning system (GPS) or the like and managing the construction machine using the obtained position information of the construction machine, managing a construction state of the construction machine, or controlling the construction machine is known (for example, see Patent Literature 1).

CITATION LIST

Patent Literature

Patent Literature 1: Japanese Laid-open Patent Publication No. 2007-147588

SUMMARY

Technical Problem

As a construction machine having a device that measures the position of the construction machine, a construction machine in which an operation guidance screen is displayed on a display device provided in a cabin of the construction machine or the operation of a work machine is controlled using the position information of the construction machine detected by the device is known. A construction performed by such a construction machine is referred to as a computer-aided construction.

A construction work based on the computer-aided construction is performed in some cases. By performing the computer-aided construction, it is expected that an excavator having GPS antennas and the like performs a slope finishing construction to thereby shorten the construction period or solve the problem of deficiency of skilled operators.

Position measurement results may vary due to the influence of an arrangement of GPS positioning satellites, the ionosphere, the troposphere, or the geographical features near a GPS antenna. In the computer-aided construction, a cutting edge position of a bucket is calculated based on the position measurement result and the work machine is controlled and a guidance screen is displayed. However, a construction surface may fluctuate or the cutting edge of the bucket displayed on the guidance screen may fluctuate due to the influence of a variation in the position measurement result. As a result, the finished construction surface may not be smooth and the visibility of the guidance screen during construction may decrease.

An object of the present invention is to reduce the influence, on a computer-aided construction, of a variation in the position measurement result in a construction machine that performs the computer-aided construction based on the position measurement result of the construction machine.

Solution to Problem

According to the present invention, there is provided a construction machine control system that controls a construction machine including a traveling device, a work machine having a working tool, and a swing structure to which the work machine is attached, the swing structure being attached to the traveling device to swing, the system comprising: a position detection device that detects a first position which is a position of a partial portion of the construction machine and outputs the first position as first position information; a state detection device that detects and outputs operation information indicating an operation of the construction machine; and a processing device that calculates a second position corresponding to the position of the partial portion using the first position information and the operation information and calculates a position of at least a partial portion of the work machine using information of the second position.

In the present invention, it is preferable that the processing device calculates the second position using a position of a specific point which is an intersection between an axis of a center of swing of the swing structure and a plane corresponding to a ground surface with which the traveling device makes contact, which is information obtained from the first position and the operation information.

In the present invention, it is preferable that the processing device applies a smoothing process to the position of the specific point and calculates the information of the second position using the position of the specific point obtained after the smoothing process.

In the present invention, it is preferable that the processing device applies a smoothing process to the first position using the operation information to calculate the information of the second position.

In the present invention, it is preferable that the processing device calculates the position of at least a partial portion of the work machine using the information of the second position when the position of the construction machine detected by the position detection device is normal, the travel of the construction machine is stopped, and the swing structure is not swinging.

The processing device preferably suspends the process of calculating the second position information when the travel of the construction machine is stopped and the swing structure is swinging.

The processing device preferably calculates the position of at least the partial portion of the work machine using the second position information obtained before the process of calculating the second position is suspended when the swing of the swing structure is stopped.

The processing device preferably stops the process of calculating the second position information when the construction machine starts traveling when the process of calculating the second position is suspended.

The processing device preferably stops the process of calculating the second position when the position detection device has normally detected the position of the construction machine and the travel of the construction machine is stopped.

The processing device preferably includes a position estimating unit that estimates the position of the construction machine using the operation information, corrects the estimated position of the construction machine obtained by the estimation, and outputs the corrected position as the second position and an error calculating unit that calculates an error included in the estimated position using at least one of the first position information and the operation information, and outputs the error to the position estimating unit and the position estimating unit preferably corrects the estimated position using the error output by the error calculating unit.

The processing device preferably selects information to be input to the error calculating unit using a detection state of the position of the construction machine by the position detection device and an operation state of the construction machine.

According to another aspect of the present invention, there is provided a construction machine including the construction machine control system.

According to the present invention, there is provided a construction machine control method of controlling a construction machine including a traveling device, a work machine having a working tool, and a swing structure to which the work machine is attached, the swing structure being attached to the traveling device to swing, the method comprising: calculating a second position of the construction machine corresponding to a position of a partial portion of the construction machine using a first position which is the position of the partial portion of the construction machine detected by a position detection device included in the construction machine and operation information of the construction machine detected by a state detection device included in the construction machine; and calculating a position of at least a partial portion of the work machine using the second position.

The second position is preferably calculated using a position of a specific point which is an intersection between an axis of the center of swing of the swing structure and a plane corresponding to a ground surface with which the traveling device makes contact, which is information obtained from the first position and the operation information.

Preferably, a smoothing process is applied to the position of the specific point and the second position is calculated using the position of the specific point obtained after the smoothing process.

Preferably, a smoothing process is applied to the first position using the operation information to calculate the second position.

Preferably, when calculating the second position, an estimated position is calculated by estimating the position of the construction machine using the operation information, an error included in the estimated position is calculated using at least one of the first position and the operation information, and the estimated error is corrected using the error output by the error calculating unit.

According to the aspects of the present invention, it is possible to reduce the influence, on a computer-aided construction, of a variation in the position measurement result in a construction machine that performs the computer-aided construction based on the position measurement result of the construction machine.

DESCRIPTION OF EMBODIMENTS

Modes (present embodiments) for carrying out the present invention will be described in detail with reference to the drawings.

First Embodiment

Overall Structure of Construction Machine

Figure 1:
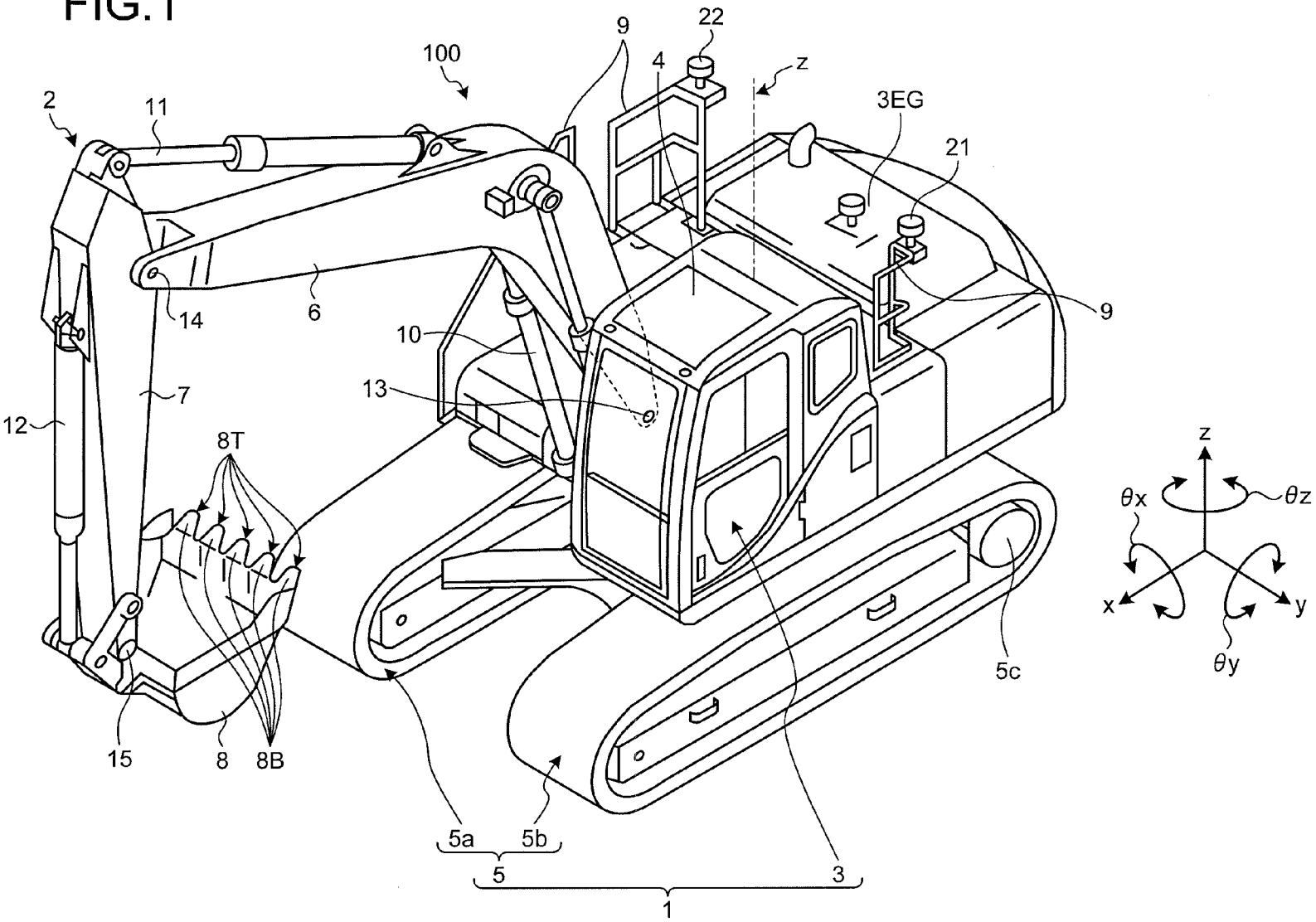
FIG. 1 is a perspective view of a construction machine according to a first embodiment.
Figure 2:
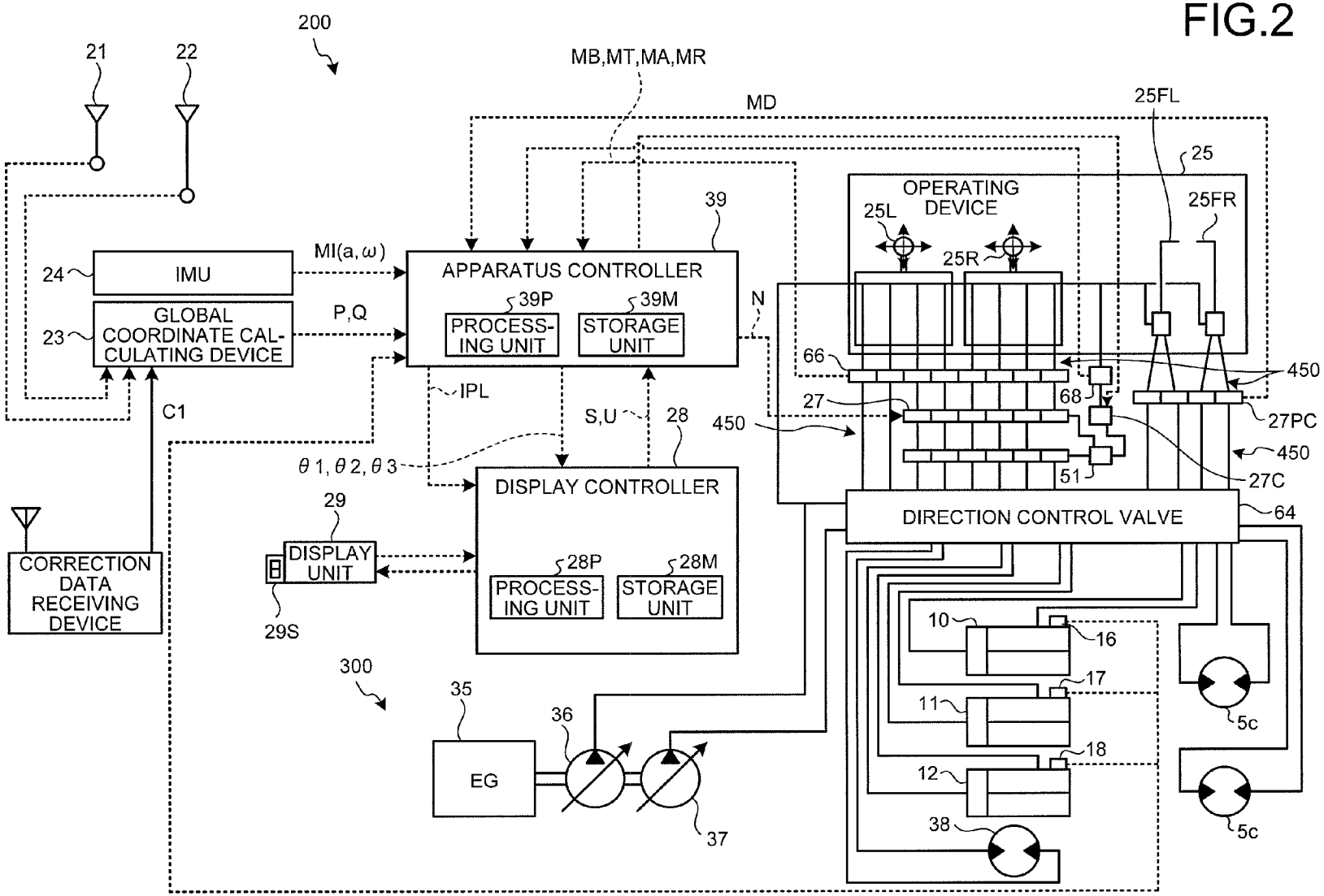
FIG. 2 is a block diagram illustrating a configuration of a control system and a hydraulic system.

FIG. 1 is a perspective view of a construction machine according to a first embodiment. FIG. 2 is a block diagram illustrating a configuration of a control system 200 and a hydraulic system 300. An excavator 100 as a construction machine includes a vehicle body 1 as a main body and a work machine 2. The vehicle body 1 includes an upper swing structure 3 which is a swing structure and a traveling device 5 as a traveling structure. The upper swing structure 3 includes a machine room 3EG in which devices such as an engine which is a power generating device and a hydraulic pump are accommodated.

In the present embodiment, although the excavator 100 uses an internal combustion engine such as a diesel engine as the engine which is a power generating device, the power generating device is not limited to the internal combustion engine. The power generating device of the excavator 100 may be a so-called hybrid-type device in which an internal combustion engine, a generator motor, and a power storage device are combined, for example. Moreover, the power generating device of the excavator 100 may be a device which does not have an internal combustion engine and in which a power storage device and a generator motor are combined.

The upper swing structure 3 has a cabin 4. The cabin 4 is provided on the other end side of the upper swing structure 3. That is, the cabin 4 is provided on the opposite side from the side on which the machine room 3EG is disposed. A display unit 29 and an operating device 25 illustrated in FIG. 2 are disposed in the cabin 4. A handrail 9 is attached to an upper side of the upper swing structure 3.

The upper swing structure 3 is mounted on the traveling device 5. The traveling device 5 includes crawler belts 5*a* and 5*b*. The traveling device 5 is driven by one or both of hydraulic motors 5*c* provided on the left and right sides thereof. When the crawler belts 5*a* and 5*b* of the traveling device 5 rotate, the excavator 100 travels. The work machine 2 is attached to a lateral side of the cabin 4 of the upper swing structure 3.

The excavator 100 may include a traveling device which includes tires instead of the crawler belts 5*a* and 5*b* and which can travel by transmitting the driving force of an engine to the tires via a transmission. An example of the excavator 100 having such a form is a wheel-type excavator.

The front side of the upper swing structure 3 is a side on which the work machine 2 and the cabin 4 are disposed and the rear side thereof is a side on which the machine room 3EG is disposed. The front-rear direction of the upper swing structure 3 corresponds to an x-axis direction. The left side when facing the front is the left side of the upper swing structure 3 and the right side when facing the front is the right side of the upper swing structure 3. The left-right direction of the upper swing structure 3 is also referred to as a width direction or a y-axis direction. The lower side of the excavator 100 or the vehicle body 1 is the side close to the traveling device 5 about the upper swing structure 3 and the upper side thereof is the side close to the upper swing structure 3 about the traveling device 5. The up-down direction of the upper swing structure 3 corresponds to a z-axis direction. When the excavator 100 is installed on a horizontal plane, the lower side is a vertical direction (that is, the side on which the gravity acts) and the upper side is the opposite side from the vertical direction.

The work machine 2 includes a boom 6, an arm 7, a bucket 8 which is a working tool, a boom cylinder 10, an arm cylinder 11, and a bucket cylinder 12. A base end of the boom 6 is rotatably attached to a front portion of the vehicle body 1 with a boom pin 13 interposed. The base end of the arm 7 is rotatably attached to a distal end of the boom 6 with an arm pin 14 interposed. The bucket 8 is attached to the distal end of the arm 7 with a bucket pin 15 interposed. The bucket 8 rotates about the bucket pin 15. The bucket 8 has a plurality of teeth 8B which is attached to the opposite side from the bucket pin 15. A cutting edge 8T is a distal end of the tooth 8B.

The bucket 8 may not have the plurality of teeth 8B. That is, the bucket 8 may be a bucket which does not have such teeth 8B as illustrated in FIG. 1 and of which the cutting edge is formed in a straight form using a steel plate. The work machine 2 may include a tilt bucket which has a single tooth, for example. A tilt bucket is a bucket which includes a bucket tilt cylinder and in which the bucket is tilted in the left-right direction so that the excavator 100 on a sloping land can shape or level a slope surface and a flat surface in an arbitrary form and can perform a rolling and compaction operation using a bottom plate. In addition to this, the work machine 2 may include a working tool such as a slope finishing bucket or a drilling attachment having a drilling tip instead of the bucket 8.

The boom cylinder 10, the arm cylinder 11, and the bucket cylinder 12 illustrated in FIG. 1 are hydraulic cylinders which are driven by the pressure of operating oil. In the following description, the pressure of operating oil will be appropriately referred to as hydraulic pressure. The boom cylinder 10 drives the boom 6 to raise and lower the boom 6. The arm cylinder 11 drives the arm 7 so as to rotate about the arm pin 14. The bucket cylinder 12 drives the bucket 8 so as to rotate about the bucket pin 15.

A direction control valve 64 illustrated in FIG. 2 is provided between the hydraulic cylinders such as the boom cylinder 10, the arm cylinder 11, and the bucket cylinder 12 and hydraulic pumps 36 and 37 illustrated in FIG. 2. The direction control valve 64 controls the flow rate of the operating oil supplied from the hydraulic pumps 36 and 37 to the boom cylinder 10, the arm cylinder 11, and the bucket cylinder 12 and changes the direction in which the operating oil flows. The direction control valve 64 includes a travel-direction control valve for driving the hydraulic motors 5*c* and a work-machine-direction control valve for controlling the boom cylinder 10, the arm cylinder 11, the bucket cylinder 12, and a swing motor 38 that allows the upper swing structure 3 to swing.

When operating oil of which the pressure is adjusted to a predetermined pilot pressure, supplied from an operating device 25, operates a spool of the direction control valve 64, the flow rate of the operating oil flowing from the direction control valve 64 is adjusted and the flow rate of the operating oil supplied from the hydraulic pumps 36 and 37 to the boom cylinder 10, the arm cylinder 11, the bucket cylinder 12, the swing motor 38, or the hydraulic motor 5*c* is controlled. As a result, the operations of the boom cylinder 10, the arm cylinder 11, the bucket cylinder 12, and the like are controlled.

Moreover, when an apparatus controller 39 illustrated in FIG. 2 controls a control valve 27 illustrated in FIG. 2, since the pilot pressure of the operating oil supplied from the operating device 25 to the direction control valve 64 is controlled, the flow rate of the operating oil supplied from the direction control valve 64 to the boom cylinder 10, the arm cylinder 11, the bucket cylinder 12, or the swing motor 38 is controlled. As a result, the apparatus controller 39 can control the operations of the boom cylinder 10, the arm cylinder 11, the bucket cylinder 12, and the upper swing structure 3.

Antennas 21 and 22 are attached to an upper portion of the upper swing structure 3. The antennas 21 and 22 are used for detecting the present position of the excavator 100. The antennas 21 and 22 are electrically connected to a global coordinate calculating device 23 illustrated in FIG. 2. The global coordinate calculating device 23 is a position detection device that detects the position of the excavator 100. The global coordinate calculating device 23 detects the present position of the excavator 100 (more specifically, the present position of a partial portion of the excavator 100) using a real time kinematic-global navigation satellite systems (RTK-GNSS: GNSS stands for a global navigation satellite system). In the following description, the antennas 21 and 22 will be appropriately referred to as GNSS antennas 21 and 22. In the present embodiment, the global coordinate calculating device 23 detects the position of at least one of the GNSS antennas 21 and 22 as the present position of a partial portion of the excavator 100. The signals corresponding to GNSS radio waves received by the GNSS antennas 21 and 22 are input to the global coordinate calculating device 23. The global coordinate calculating device 23 calculates the installed position of the GNSS antennas 21 and 22 in a global coordinate system. Although a global positioning system (GPS) can be used as an example of a global navigation satellite system, the global navigation satellite system is not limited thereto.

In RTK-GNSS, a positioning state changes due to the influence of an arrangement of positioning satellites, the ionosphere, the troposphere, or the geographical features near a GNSS antenna. Examples of the positioning state include Fix (accuracy: approximately ±1 cm to 2 cm), Float (accuracy: approximately ±10 cm to several meters), Single Point Positioning (accuracy: approximately ±several meters), and No Solution (Unable to compute a solution). In the following description, the positioning state Fix will be referred to as normal and the states other than Fix will be referred to as abnormal.

As illustrated in FIG. 1, the GNSS antennas 21 and 22 are preferably installed on the upper swing structure 3 at both end positions separated in the left-right direction (that is, the width direction) of the excavator 100. In the present embodiment, the GNSS antennas 21 and 22 are attached to the handrails 9 that are attached to both sides in the width direction of the upper swing structure 3. Although the position at which the GNSS antennas 21 and 22 are attached to the upper swing structure 3 is not limited to the handrail 9, it is preferable because the detection accuracy of the present position of the excavator 100 improves when the GNSS antennas 21 and 22 are provided at distant positions as much as possible. Moreover, the GNSS antennas 21 and 22 are preferably installed at such a position that the operator sight is not obstructed as much as possible. For example, the GNSS antennas 21 and 22 may be disposed on a counterweight disposed at the rear side of the machine room 3EG.

As illustrated in FIG. 2, the hydraulic system 300 of the excavator 100 includes an engine 35 and the hydraulic pumps 36 and 37. The hydraulic pumps 36 and 37 are driven by the engine 35 and discharge operating oil. The operating oil discharged from the hydraulic pumps 36 and 37 is supplied to the boom cylinder 10, the arm cylinder 11, and the bucket cylinder 12. Moreover, the excavator 100 includes the swing motor 38. The swing motor 38 is a hydraulic motor and is driven by the operating oil discharged from the hydraulic pumps 36 and 37. The swing motor 38 allows the upper swing structure 3 to swing. Although the two hydraulic pumps 36 and 37 are illustrated in FIG. 2, one hydraulic pump may be provided. The swing motor 38 is not limited to the hydraulic motor but may be an electric motor.

The control system 200 which is a construction machine control system includes the global coordinate calculating device 23, an inertial measurement unit (IMU) 24 which is a state detection device that detects an angular velocity and an acceleration, the operating device 25, the apparatus controller 39 as a processing device, a display controller 28 as a processing device, and a display unit 29. The operating device 25 is a device for operating at least one of the work machine 2, the upper swing structure 3, and the traveling device 5 illustrated in FIG. 1. The operating device 25 receives an operation of an operator performed to drive the work machine 2 or the like and outputs a pilot pressure corresponding to the amount of the operation.

The operating device 25 includes a left operating lever 25L provided on the left side of an operator and a right operating lever 25R provided on the right side of an operator. The movements in the front-rear and left-right directions of the left operating lever 25L and the right operating lever 25R correspond to 2-axis operations. For example, the operation in the front-rear direction of the right operating lever 25R corresponds to an operation of the boom 6. For example, the operation in the left-right direction of the right operating lever 25R corresponds to an operation of the bucket 8. For example, the operation in the front-rear direction of the left operating lever 25L corresponds to an operation of the arm 7. For example, the operation in the left-right direction of the left operating lever 25L corresponds to a swing of the upper swing structure 3.

In the present embodiment, the operating device 25 is a pilot pressure-type operating device. Operating oil which is decompressed to a predetermined pilot pressure by a decompression valve (not illustrated) is supplied from the hydraulic pump 36 to the operating device 25 based on a boom operation, a bucket operation, an arm operation, a swing operation, and a traveling operation.

The supply of the pilot pressure to a pilot oil passage 450 is enabled according to the operation in the front-rear direction of the right operating lever 25R and the operation of the boom 6 by the operator is received. A valve mechanism included in the right operating lever 25R is opened according to the amount of operation of the right operating lever 25R and the operating oil is supplied to the pilot oil passage 450. In this case, a pressure sensor 66 detects the pressure of the operating oil in the pilot oil passage 450 as a pilot pressure. The pressure sensor 66 transmits the detected pilot pressure to the apparatus controller 39 as a boom operation signal MB.

A pressure sensor 68, a control valve (hereinafter appropriately referred to as an intervention valve) 27C, and a shuttle valve 51 are provided in the pilot oil passage 450 between the operating device 25 and the boom cylinder 10. The supply of the pilot pressure to the pilot oil passage 450 is enabled according to the operation in the left-right direction of the right operating lever 25R and the operation of the bucket 8 by the operator is received. The valve mechanism included in the right operating lever 25R is opened according to the amount of operation of the right operating lever 25R and the operating oil is supplied to the pilot oil passage 450. In this case, the pressure sensor 66 detects the pressure of the operating oil in the pilot oil passage 450 as a pilot pressure. The pressure sensor 66 transmits the detected pilot pressure to the apparatus controller 39 as a bucket operation signal MT.

The supply of the pilot pressure to the pilot oil passage 450 is enabled according to the operation in the front-rear direction of the left operating lever 25L and the operation of the arm 7 by the operator is received. A valve mechanism included in the left operating lever 25L is opened according to the amount of operation of the left operating lever 25L and the operating oil is supplied to the pilot oil passage 450. In this case, the pressure sensor 66 detects the pressure of the operating oil in the pilot oil passage 450 as a pilot pressure. The pressure sensor 66 transmits the detected pilot pressure to the apparatus controller 39 as an arm operation signal MA.

The supply of the pilot pressure to the pilot oil passage 450 is enabled according to the operation in the left-right direction of the left operating lever 25L and the swing operation of the upper swing structure 3 by the operator is received. The valve mechanism included in the left operating lever 25L is opened according to the amount of operation of the left operating lever 25L and the operating oil is supplied to the pilot oil passage 450. In this case, the pressure sensor 66 detects the pressure of the operating oil in the pilot oil passage 450 as a pilot pressure. The pressure sensor 66 transmits the detected pilot pressure to the apparatus controller 39 as a swing operation signal MR.

When the right operating lever 25R is operated, the operating device 25 supplies a pilot pressure having a magnitude corresponding to the amount of operation of the right operating lever 25R to the direction control valve 64. When the left operating lever 25L is operated, the operating device 25 supplies a pilot pressure having a magnitude corresponding to the amount of operation of the left operating lever 25L to the control valve 27. With the pilot pressure, the spool of the direction control valve 64 moves.

The control valve 27 is provided in the pilot oil passage 450. The amounts of operation of the right operating lever 25R and the left operating lever 25L are detected by the pressure sensor 66 provided in the pilot oil passage 450. The pilot pressure detected by the pressure sensor 66 is input to the apparatus controller 39. The apparatus controller 39 outputs a control signal N of the pilot oil passage 450, corresponding to the input pilot pressure, to the control valve 27 to open or close the pilot oil passage 450. The relation between the operating direction of the right operating lever 25R or the left operating lever 25L and the operating target (the bucket 8, the arm 7, the boom 6, and the upper swing structure 3) is not limited to the above and other relations may be used.

The operating device 25 includes travel levers 25FL and 25FR. In the present embodiment, since the operating device 25 is a pilot pressure-type operating device, decompressed operating oil is supplied from the hydraulic pump 36 to the direction control valve 64 and the spool of the direction control valve 64 is driven based on the pressure of the operating oil in the pilot oil passage 450. The operating oil is supplied from the hydraulic pumps 36 and 37 to the hydraulic motors 5*c*, 5*c* included in the traveling device 5 of the excavator 100 and the traveling device 5 can travel. The pressure of the operating oil in the pilot oil passage 450 (that is, the pilot pressure) is detected by a pressure sensor 27PC.

When the operator of the excavator 100 operates the traveling device 5, the operator operates the travel levers 25FL and 25FR. The amounts of operation of the travel levers 25FL and 25FR by the operator are detected by the pressure sensor 27PC and are output to the apparatus controller 39 as an operation signal MD.

The amounts of operation of the left operating lever 25L and the right operating lever 25R may be detected by a potentiometer, a hall IC, and the like, for example, and the apparatus controller 39 may control the direction control valve 64 and the control valve 27 based on these detection values to control the work machine 2. In this manner, the left operating lever 25L and the right operating lever 25R may be electric-type operating levers.

The control system 200 includes a first stroke sensor 16, a second stroke sensor 17, and a third stroke sensor 18. For example, the first stroke sensor 16 is provided in the boom cylinder 10, the second stroke sensor 17 is provided in the arm cylinder 11, and the third stroke sensor 18 is provided in the bucket cylinder 12. The first stroke sensor 16 detects a displacement amount corresponding to an extension of the boom cylinder 10 and outputs the displacement amount to the apparatus controller 39. The second stroke sensor 17 detects a displacement amount corresponding to an extension of the arm cylinder 11 and outputs the displacement amount to the apparatus controller 39. The third stroke sensor 18 detects a displacement amount corresponding to an extension of the bucket cylinder 12 and outputs the displacement amount to the apparatus controller 39.

The apparatus controller 39 includes a processing unit 39P which is a processor such as a central processing unit (CPU) and a storage unit 39M which is a storage device such as a random access memory (RAM) and a read only memory (ROM). The apparatus controller 39 receives the detection value of the global coordinate calculating device 23, the detection value of the IMU 24, the detection values of the pressure sensors 27PC, 66, and 68, the detection value of the first stroke sensor 16, the detection value of the second stroke sensor 17, and the detection value of the third stroke sensor 18. The apparatus controller 39 calculates position information IPL related to the position of the excavator 100 from the detection value of the global coordinate calculating device 23 and the detection value of the IMU 24 and outputs the position information IPL to the display controller 28. The apparatus controller 39 controls the control valve 27 and the intervention valve 27C based on the detection value of the pressure sensor 66 illustrated in FIG. 2.

The direction control valve 64 illustrated in FIG. 2 is a proportional control valve, for example, and is controlled by the operating oil supplied from the operating device 25. The direction control valve 64 is disposed between the hydraulic pumps 36 and 37 and a hydraulic actuator such as the boom cylinder 10, the arm cylinder 11, the bucket cylinder 12, and the swing motor 38. The direction control valve 64 controls the flow rate of the operating oil supplied from the hydraulic pumps 36 and 37 to the boom cylinder 10, the arm cylinder 11, the bucket cylinder 12, and the swing motor 38.

The global coordinate calculating device 23 receives correction data C1 from a correction data receiving device 26 illustrated in FIG. 2. The correction data receiving device 26 is connected to the global coordinate calculating device 23. The correction data C1 is information which can be used in RTK-GNSS, generated by a GNSS receiver provided outside the excavator 100 and is information transmitted from a device having the same standard communication function as the correction data receiving device 26. Moreover, the correction data receiving device 26 may be configured as a modem for telephone lines and the correction data C1 may be obtained from the outside using a correction data distribution service. The correction data receiving device 26 outputs the correction data C1 to the global coordinate calculating device 23. The GNSS antennas 21 and 22 receive signals from a plurality of positioning satellites and output the received signals to the global coordinate calculating device 23.

The global coordinate calculating device 23 measures reference position data P1 which is the position of the GNSS antenna 21 and reference position data P2 which is the position of the GNSS antenna 22 based on signals of the positioning satellite input from the GNSS antennas 21 and 22 and the correction data C1 received from the correction data receiving device 26. The global coordinate calculating device 23 calculates swing structure direction data Q from the relative position between the reference position data P1 which is the position of the GNSS antenna 21 and the reference position data P2 which is the position of the GNSS antenna 22. The GNSS antennas 21 and 22 and the global coordinate calculating device 23 may form a GPS compass to obtain the swing structure direction data Q.

The GNSS antennas 21 and 22 are provided in a portion of the excavator 100. Thus, the reference position data P1 and P2 is information indicating the position of a partial portion of the excavator 100 (specifically, the position of a portion in which the GNSS antennas 21 and 22 are provided). In the following description, the position of the portion in which the GNSS antennas 21 and 22 are provided will be appropriately referred to as a first position. The reference position data P1 and P2 is first position information.

In the present embodiment, the swing structure direction data Q is an angle between a direction determined from reference position data P acquired by the GNSS antennas 21 and 22 (that is, at least one of the reference position data P1 and the reference position data P2) and a reference direction (for example, the north) of a global coordinate (that is, an azimuth angle). The azimuth angle is also a yaw angle of the excavator 100. The swing structure direction data Q indicates the direction in which the upper swing structure 3 (that is, the work machine 2) faces.

The global coordinate calculating device 23 includes a processing unit which is a processor such as a CPU and a storage unit which is a storage device such as a RAM and a ROM. The global coordinate calculating device 23 outputs the measured two items of the reference position data P1 and P2 (that is, the reference position data P) and the swing structure direction data Q to the apparatus controller 39.

The display controller 28 includes a processing unit 28P which is a processor such as a CPU and a storage unit 28M which is a storage device such as a RAM and a ROM. The display controller 28 generates bucket cutting edge position data S indicating a cutting edge position which is a three-dimensional position of the cutting edge 8T of the bucket 8 using the position information IPL of the excavator 100 obtained from the apparatus controller 39 as well as displays an image of a guidance screen (described later) or the like, for example, on the display unit 29. The display unit 29 is a liquid crystal display or the like, for example, but is not limited to this. A touch panel in which an input unit and a display unit are integrated, for example, may be used as the display unit 29. In the present embodiment, a switch 29S is provided near the display unit 29. The switch 29S is an input device for executing excavation control (described later) and stopping excavation control in execution. When a touch panel is used as the display unit 29, the switch 29S may be incorporated into the input unit of the touch panel.

The display controller 28 can display an image of a target construction surface of an object to be excavated by the work machine 2 and an image of the bucket 8 generated using the bucket cutting edge position data S on the display unit 29 as a guidance screen. The display controller 28 can allow the operator of the excavator 100 to understand the positional relation between the target construction surface and the bucket 8 with the aid of the guidance screen and mitigate the burden on the operator when performing the computer-aided construction.

The IMU 24 is a state detection device that detects operation information MI indicating the operation of the excavator 100. The operation of the excavator 100 includes either the operation of the upper swing structure 3 or the operation of the traveling device 5. In the present embodiment, the operation information MI may include information indicating the attitude of the excavator 100. Examples of the information indicating the attitude of the excavator 100 include a roll angle, a pitch angle, and an azimuth angle of the excavator 100.

In the present embodiment, the IMU 24 detects an angular velocity and an acceleration of the excavator 100. When the excavator 100 operates, various acceleration components such as an acceleration generated during traveling, an angular acceleration and a gravitational acceleration generated during swing occur in the excavator 100. The IMU 24 detects an acceleration including at least the gravitational acceleration and outputs the detected acceleration without distinguishing the types of the respective acceleration components. The gravitational acceleration is an acceleration corresponding to the gravity. The IMU 24 detects an acceleration a in the x-, y-, and z-axis directions in the vehicle body coordinate system (x, y, z) illustrated in FIG. 1 and an angular velocity (rotational angular velocity) ω about the x-, y-, and z-axes. These values constitute the operation information MI. The vehicle body coordinate system is a three-dimensional coordinate system based on the excavator 100, represented by (x, y, z).

The operation information MI detected by the IMU 24 includes an angular velocity ω when the upper swing structure 3 swings about the z-axis serving as the axis of the center of swing of the upper swing structure 3. The swing angular velocity ω may be calculated by time-differentiating the swing angle of the upper swing structure 3 acquired from the information indicating the position of the GNSS antennas 21 and 22. By time-integrating the swing angular velocity ω, it is possible to calculate the swing angle.

The IMU 24 is attached to the upper swing structure 3. The IMU 24 is preferably provided on the axis of the center of swing of the upper swing structure 3 of the excavator 100, for example, in order to detect the acceleration and the like with higher accuracy. However, the IMU 24 may be provided in a lower portion of the cabin 4.

Figure 3:
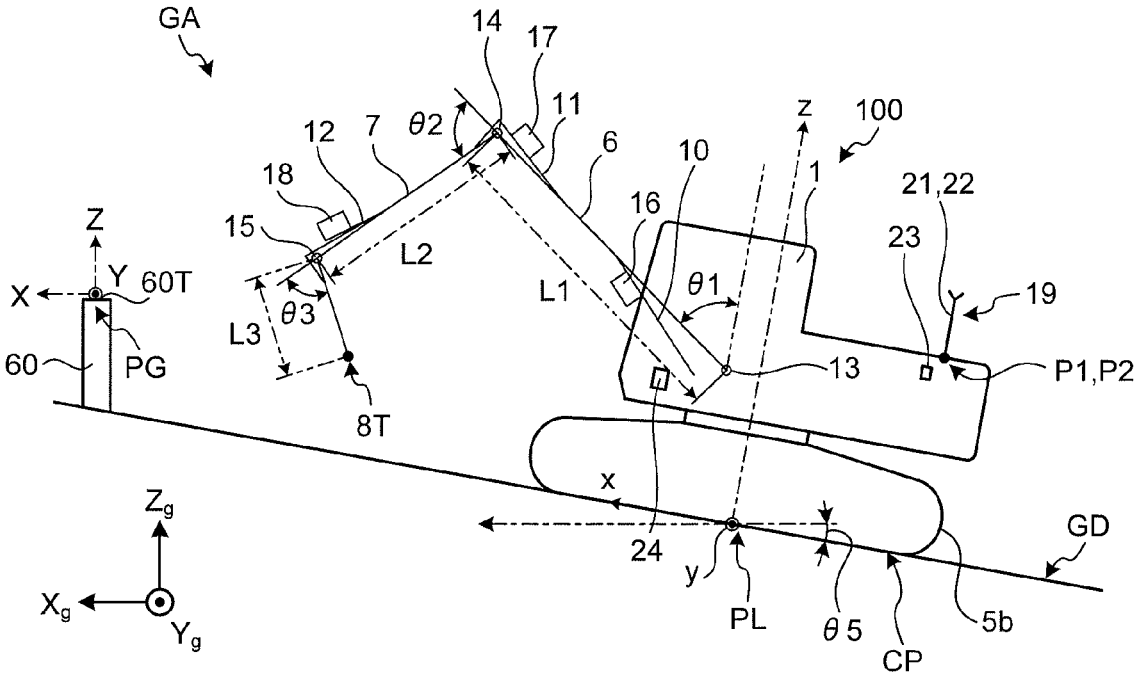
FIG. 3 is a side view of an excavator.
Figure 4:
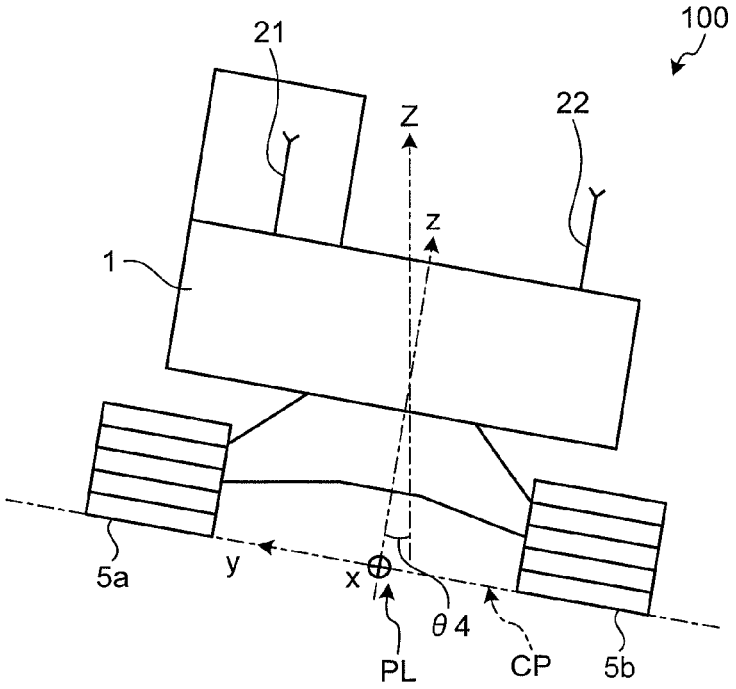
FIG. 4 is a rear view of an excavator.

FIG. 3 is a side view of the excavator 100. FIG. 4 is a rear view of the excavator 100. A tilt angle θ4 in the left-right direction (that is, the width direction) of the vehicle body 1 is a roll angle of the excavator 100, a tilt angle θ5 in the front-rear direction of the vehicle body 1 is a pitch angle of the excavator 100, and the angle of the upper swing structure 3 about the z-axis is the azimuth angle of the excavator 100. The roll angle is calculated by time-integrating the angular velocity about the x-axis detected by the IMU 24. The pitch angle is calculated by time-integrating the angular velocity about the y-axis detected by the IMU 24. The azimuth angle is calculated by time-integrating the angular velocity about the z-axis detected by the IMU 24. The angular velocity about the z-axis is the angular velocity ω during swing of the excavator 100. That is, by time-integrating the swing angular velocity ω, it is possible to obtain the azimuth angle of the excavator 100 (more specifically, the upper swing structure 3).

The IMU 24 updates the acceleration and the angular velocity of the excavator 100 at a predetermined cycle. The updating cycle of the IMU 24 is preferably shorter than the updating cycle of the global coordinate calculating device 23. The acceleration and the angular velocity detected by the IMU 24 are output to the apparatus controller 39 as the operation information MI. The apparatus controller 39 performs filtering and integration processes on the operation information MI acquired from the IMU 24 to obtain the tilt angle θ4 which is a roll angle, the tilt angle θ5 which is a pitch angle, and the azimuth angle. The apparatus controller 39 outputs the obtained tilt angles θ4 and θ5 and the azimuth angle to the display controller 28 as the position information IPL related to the position of the excavator 100.

The display controller 28 acquires the reference position data P and the swing structure direction data Q from the global coordinate calculating device 23. The swing structure direction data Q is information indicating the direction of the excavator 100, and in the present embodiment, is information indicating the direction of the upper swing structure 3. Specifically, the swing structure direction data Q is the azimuth angle of the upper swing structure 3. In the present embodiment, the display controller 28 generates bucket cutting edge position data S as work machine position data.

The bucket cutting edge position data S may be generated by the apparatus controller 39. Moreover, the display controller 28 generates target excavation landform data U indicating a target shape of an excavation object using the bucket cutting edge position data S and target construction information T. The target construction information T is stored in the storage unit 28M (a target construction information storage unit 28C) of the display controller 28. The target construction information T is information serving as a finishing target after the work machine 2 included in the excavator 100 excavates the excavation object and includes information on a target construction surface obtained from design data. The target excavation landform data U is information indicating the position of a single or a plurality of inflection points appearing before and after an excavation object position when the excavation object position is defined as the intersection between the target construction surface and a perpendicular line that passes through a cutting edge position at the present time of the cutting edge 8T in the vehicle body coordinate system and is angle information of the lines appearing before and after the inflection points.

The apparatus controller 39 calculates a tilt angle θ1 (see FIG. 3) of the boom 6 in relation to the direction (z-axis direction) perpendicular to a horizontal plane in the vehicle body coordinate system from a boom cylinder length detected by the first stroke sensor 16. The apparatus controller 39 calculates a tilt angle θ2 (see FIG. 3) of the arm 7 in relation to the boom 6 from an arm cylinder length detected by the second stroke sensor 17. The apparatus controller 39 calculates a tilt angle θ3 of the bucket 8 in relation to the arm 7 from a bucket cylinder length detected by the third stroke sensor 18. The IMU 24 outputs the swing angular velocity ω to the apparatus controller 39.

The apparatus controller 39 acquires, from the IMU 24, the swing angular velocity ω of the upper swing structure 3 when the upper swing structure 3 swings about the z-axis illustrated in FIG. 1 as described above. Moreover, the apparatus controller 39 acquires, from the pressure sensor 66, the boom operation signal MB, the bucket operation signal MT, the arm operation signal MA, and the swing operation signal MR.

The apparatus controller 39 acquires the target excavation landform data U from the display controller 28. The apparatus controller 39 calculates the position of the cutting edge 8T of the bucket 8 (hereinafter appropriately referred to a cutting edge position) from the angles (θ1, θ2, and θ3) of the work machine 2 calculated by itself. The storage unit 39M of the apparatus controller 39 stores data of the work machine 2 (hereinafter appropriately referred to as work machine data). The work machine data includes design dimensions such as a length L1 of the boom 6, a length L2 of the arm 7, and a length L3 of the bucket 8. As illustrated in FIG. 3, the length L1 of the boom 6 corresponds to the length between the boom pin 13 and the arm pin 14. The length L2 of the arm 7 corresponds to the length between the arm pin 14 and the bucket pin 15. The length L3 of the bucket 8 corresponds to the length between the bucket pin 15 and the cutting edge 8T of the bucket 8. The cutting edge 8T is a distal end of the tooth 8B illustrated in FIG. 1. Moreover, the work machine data includes information on the position of the boom pin 13 in relation to a position PL of the vehicle body coordinate system. The apparatus controller 39 can calculate the cutting edge position in relation to the position PL using the lengths L1, L2, and L3, the tilt angles θ1, θ2, and θ3, and the position PL.

The apparatus controller 39 adjusts the boom operation signal MB, the bucket operation signal MT, and the arm operation signal MA input from the operating device 25 based on the target excavation landform data U, the distance between the bucket 8 and the cutting edge 8T, and the velocity of the cutting edge 8T of the bucket 8 so that the cutting edge 8T of the bucket 8 moves according to the target excavation landform data U. The apparatus controller 39 generates the control signal N for controlling the work machine 2 so that the cutting edge 8T of the bucket 8 moves according to the target excavation landform data U and outputs the control signal N to the control valve 27 illustrated in FIG. 2. With such a process, the velocity at which the work machine 2 approaches the target excavation landform data U is limited according to the distance to the target excavation landform data U.

According to the control signal N from the apparatus controller 39, the two control valves 27 provided in each of the boom cylinder 10, the arm cylinder 11, and the bucket cylinder 12 are opened and closed. The spool of the direction control valve 64 operates based on the operation of the left operating lever 25L or the right operating lever 25R and an opening/closing command of the control valve 27 and the operating oil is supplied to the boom cylinder 10, the arm cylinder 11, and the bucket cylinder 12.

The global coordinate calculating device 23 detects the reference position data P1 and P2 of the GNSS antennas 21 and 22 in the global coordinate system. In the present embodiment, the global coordinate system is a GNSS coordinate system, for example. In FIG. 3, the global coordinate system is a three-dimensional coordinate system represented by (Xg, Yg, Zg). A local coordinate system is a three-dimensional coordinate system based on a position PG of a reference post 60, for example, serving as a reference set in a work area GA of the excavator 100, represented by (X, Y, Z). As illustrated in FIG. 3, the position PG is positioned at a distal end 60T of the reference post 60 set in the work area GA, for example. The global coordinate system (Xg, Yg, Zg) and the local coordinate system (X, Y, Z) are transformable to each other.

The display controller 28 illustrated in FIG. 2 calculates the position of the vehicle body coordinate system in the global coordinate system based on the detection result obtained by the global coordinate calculating device 23. In the present embodiment, for example, the position PL of the vehicle body coordinate system is the intersection between the z-axis which is the axis of the center of swing of the swing structure and a plane corresponding to the ground surface with which the traveling device 5 makes contact. In the present embodiment, the coordinate of the position PL is (0, 0, 0) in the vehicle body coordinate system. The ground surface with which the traveling device 5 makes contact is a surface GD of the work area GA with which the crawler belts 5*a* and 5*b* make contact. The plane corresponding to the ground surface with which the traveling device 5 makes contact may be the surface GD of the work area GA and may be a plane CP defined by a ground portion with which the crawler belts 5*a* and 5*b* make contact. The plane CP defined by the ground portion with which the crawler belts 5*a* and 5*b* make contact is uniquely determined from the design dimensions of the excavator 100 in the vehicle body coordinate system (x, y, z).

The position PL is not limited to the intersection between the z-axis and the plane CP. In the present embodiment, the position of a pseudo fixed point (described later) may be identical to the position PL and may be not. The position PL of the vehicle body coordinate system may be in another place, and for example, the central point of the axial length of the boom pin 13 may be defined as the position PL. The position PL may be positioned on the z-axis and on a swing circle along which the upper swing structure 3 swings. As described above, since the apparatus controller 39 calculates the cutting edge position in relation to the position PL (that is, the cutting edge position in the vehicle body coordinate system), the coordinate of the cutting edge position in the vehicle body coordinate system can be converted to the coordinate of the cutting edge position in the global coordinate system as long as the coordinate of the position PL in the global coordinate system is obtained.

The apparatus controller 39 performs control so that the velocity in the direction in which the work machine 2 approaches the excavation object is equal to or smaller than a limit velocity in order to suppress the bucket 8 from biting into the target excavation landform. This control is appropriately referred to as excavation control. The excavation control involves controlling the velocity in the direction in which the work machine 2 approaches the excavation object so as to be equal to or smaller than the limit velocity while calculating the relative position between the work machine 2 and the excavation object based on the target excavation landform data U and the bucket cutting edge position data S acquired from the display controller 28. By executing such control, the excavation object can be constructed in a target shape (the shape indicated by the target construction information T). Next, the control system 200 will be described in more detail.

<Control System 200>

Figure 5:
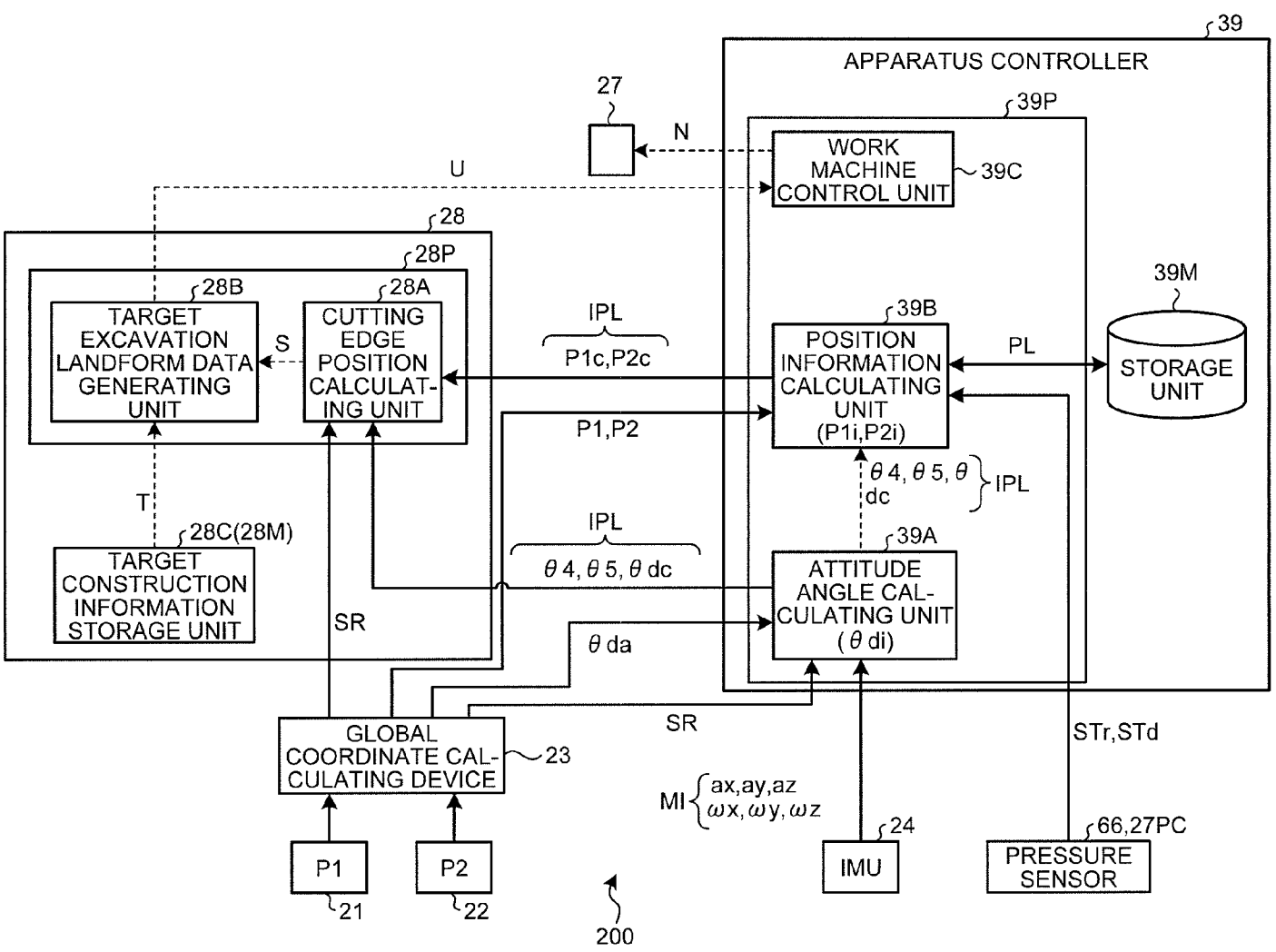
FIG. 5 is a control block diagram of a control system according to the first embodiment.

FIG. 5 is a control block diagram of the control system 200 according to the first embodiment. In the present embodiment, the apparatus controller 39 and the display controller 28 of the control system 200 can exchange information via a signal line. Moreover, the apparatus controller 39 can acquire information from the global coordinate calculating device 23 via a signal line. The signal line via which information is transmitted within the control system 200 may be an in-vehicle signal line like a controller area network (CAN). In the control system 200 of the present embodiment, the apparatus controller 39 and the display controller 28 are separate devices, but both controllers may be realized as one device.

The display controller 28 includes a cutting edge position calculating unit 28A, a target excavation landform data generating unit 28B, and a target construction information storage unit 28C. The cutting edge position calculating unit 28A and the target excavation landform data generating unit 28B are realized when the processing unit 28P executes a computer program stored in the storage unit 28M. The target construction information storage unit 28C is realized by a portion of a storage area of the storage unit 28M.

The cutting edge position calculating unit 28A generates swing center position data XR indicating the position of the center of swing of the excavator 100, which passes through the z-axis serving as the axis of the center of swing of the upper swing structure 3 based on the position information IPL acquired from the apparatus controller 39. The position information IPL that the cutting edge position calculating unit 28A acquires from the apparatus controller 39 includes reference position data P1*c* and P2*c* based on the reference position data P1 and P2 and an attitude angle of the excavator 100. The attitude angle is the roll angle θ4, the pitch angle θ5, and an azimuth angle θdc.

The cutting edge position calculating unit 28A generates the bucket cutting edge position data S indicating the present position of the cutting edge 8T of the bucket 8 based on the swing center position data XR, the tilt angles θ1, θ2, and θ3 of the work machine 2, the length L1 of the boom 6, the length L2 of the arm 7, and the length L3 of the bucket 8 and outputs the bucket cutting edge position data S to the target excavation landform data generating unit 28B. The bucket cutting edge position data S is information indicating the position of the work machine 2. In the present embodiment, the position of the work machine 2 is not limited to the cutting edge position (that is, the three-dimensional position of the cutting edge 8T of the bucket 8) but may be the position of a specific portion of the work machine 2. For example, the position of the work machine 2 may be the position of the backside of the bucket 8, the position of the bottom of a slope finishing bucket, or the position of a portion at which the attachment of the work machine 2 is attached.

The target excavation landform data generating unit 28B acquires the target construction information T stored in the target construction information storage unit 28C and the bucket cutting edge position data S output from the cutting edge position calculating unit 28A. The target excavation landform data generating unit 28B sets the intersection between the target construction surface and a perpendicular line that passes through the cutting edge position at the present time of the cutting edge 8T in the vehicle body coordinate system as an excavation object position. The target excavation landform data generating unit 28B generates the target excavation landform data U based on the target construction information T and the bucket cutting edge position data S and outputs the target excavation landform data U to a work machine control unit 39C (described later) included in the processing unit 39P of the apparatus controller 39.

The processing unit 39P of the apparatus controller 39 includes an attitude angle calculating unit 39A, a position information calculating unit 39B, and the work machine control unit 39C. The attitude angle calculating unit 39A, the position information calculating unit 39B, and the work machine control unit 39C are realized when the processing unit 39P executes a computer program stored in the storage unit 39M. In the present embodiment, the work machine control unit 39C may be a control device that is independent from the apparatus controller 39.

The attitude angle calculating unit 39A receives the acceleration a (ax, ay, az) and the angular velocity ω (ωx, ωy, ωz) (that is, the operation information MI) which are the detection values of the IMU 24 and the swing structure direction data Q (azimuth angle θda) which is the detection value of the global coordinate calculating device 23. Moreover, the attitude angle calculating unit 39A and the position information calculating unit 39B of the processing unit 39P receive detection values STr and STd of the pressure sensors 66 and 27PC.

The global coordinate calculating device 23 generates state information SR which is information indicating a reception state of radio waves or a communication state with the apparatus controller 39 and outputs the state information SR to the processing unit 39P of the apparatus controller 39 and the processing unit 28P of the display controller 28. The state information SR has information indicating the reception state or the communication state in each of the cases in which the global coordinate calculating device 23 was unable to receive radio waves, the reception state of radio waves degraded, or a fault occurred in the communication between the global coordinate calculating device 23 and the apparatus controller 39. The information indicating the reception state or the communication state indicates a positioning state of the global coordinate calculating device 23. As described above, examples of the positioning state include a good positioning accuracy state (Fix), a state in which positioning is not possible (No Solution), a state in which positioning is possible but a small amount of information is collected, and a poor positioning accuracy state (Float, Single Point Positioning). That is, the global coordinate calculating device 23 is a positioning state determining device that determines whether a problem has occurred in the RTK-GNSS positioning.

In the present embodiment, the positioning state determining device (that is, the global coordinate calculating device 23) determines that the good positioning accuracy state (Fix) is a normal positioning state. Moreover, the global coordinate calculating device 23 determines that the state in which positioning is not possible (No Solution), the state in which positioning is possible but a small amount of information is collected, and the poor positioning accuracy state (Float, Single Point Positioning) are abnormal positioning states. That is, the global coordinate calculating device 23 determines the positioning state Fix as normal and the state other than Fix as abnormal.

Upon acquiring the state information SR, the display controller 28 displays information corresponding to the positioning state on the display unit 29 illustrated in FIG. 2. When the state information SR indicates the state in which positioning is not possible, the display controller 28 displays a message on the display unit 29 illustrated in FIG. 2, indicating that an abnormality has occurred in the RTK-GNSS positioning.

The attitude angle calculating unit 39A calculates the tilt angle θ4 which is the roll angle of the excavator 100 and the tilt angle θ5 which is the pitch angle of the excavator 100 from the detection values of the IMU 24 and outputs the angles θ4 and θ5 to the position information calculating unit 39B and the cutting edge position calculating unit 28A of the display controller 28. The attitude angle calculating unit 39A can calculate an azimuth angle θdi by integrating the angular velocity ω about the z-axis detected by the IMU 24. The roll angle θ4, the pitch angle θ5, and the azimuth angle θdi are the attitude angle.

The attitude angle calculating unit 39A switches the azimuth angle θdi calculated by itself and the azimuth angle θda acquired from the global coordinate calculating device 23 according to the state of the global coordinate calculating device 23 which is the position detection device and outputs the azimuth angle to the cutting edge position calculating unit 28A of the display controller 28 or the position information calculating unit 39B as the azimuth angle θdc. That is, when the RTK-GNSS positioning is normal, the bucket cutting edge position data S is calculated using the azimuth angle θda acquired from the global coordinate calculating device 23. When the RTK-GNSS positioning is abnormal, the bucket cutting edge position data S is calculated using the azimuth angle θdi obtained by integrating the angular velocity ω about the z-axis detected by the IMU 24. Moreover, the tilt angles θ4 and θ5 and the azimuth angle θdc transmitted from the attitude angle calculating unit 39A to the display controller 28 are the position information IPL related to the position of the excavator 100. In the following description, the tilt angle θ4 will be appropriately referred to as a roll angle θ4 and the tilt angle θ5 will be appropriately referred to as a pitch angle θ5.

In the present embodiment, as described above, the position information IPL is information related to the position of the excavator 100 which is a construction machine. The position information IPL includes information necessary for calculating the position of the excavator 100 as well as the information of the position itself of the excavator 100. Examples of the information of the position itself of the excavator 100 include the reference position data P1 and P2 and the bucket cutting edge position data S, and examples of the information necessary for calculating the position of the excavator 100 include the tilt angles θ4 and θ5 and the azimuth angle (θda, θdi, or θdc).

The position information calculating unit 39B calculates the position indicated by the reference position data P1 and P2 using the reference position data P1 and P2 acquired from the global coordinate calculating device 23 and the operation information MI acquired from the IMU 24. The reference position data P1 and P2 is the first position information. In the following description, the position that the position information calculating unit 39B calculates from the reference position data P1 and P2 and the operation information MI will be appropriately referred to as a second position. The second position information is reference position data P1*i* and P2*i*. The reference position data P1*i* and P2*i* is generated by the position information calculating unit 39B. In the following description, the reference position data P1 and P2 output by the global coordinate calculating device 23 will be appropriately referred to as first reference position data P1 and P2, and the reference position data P1*i* and P2*i* generated by the position information calculating unit 39B will be appropriately referred to as second reference position data P1*i* and P2*i*.

The second reference position data P1*i* and P2*i* can be calculated based on the roll angle θ4 and the pitch angle θ5 that the attitude angle calculating unit 39A calculates from the acceleration a (ax, ay, az) and the angular velocity ω (ωx, ωy, ωz) which are the detection values of the IMU 24 and the azimuth angle θdc output from the attitude angle calculating unit 39A. The azimuth angle θdc is the azimuth angle θda that the attitude angle calculating unit 39A acquires from the global coordinate calculating device 23 or an azimuth angle obtained by adding an angle obtained by integrating the swing angular velocity ω to the azimuth angle θda. In this case, the global coordinate calculating device 23 calculates the azimuth angle θda from the first reference position data P1 and P2 and outputs the azimuth angle θda to the attitude angle calculating unit 39A. When the swing angular velocity ω is 0, the azimuth angle θdc output from the attitude angle calculating unit 39A is the same as the azimuth angle θda acquired from the global coordinate calculating device 23. In this way, the position information calculating unit 39B generates the second reference position data P1*i* and P2*i* using the first reference position data P1 and P2 and the operation information MI. In the present embodiment, the attitude angle calculating unit 39A may acquire the first reference position data P1 and P2 from the global coordinate calculating device 23 and calculate the azimuth angle θda using the first reference position data P1 and P2.

The position measurement result obtained by the global coordinate calculating device 23 may vary due to the influence of an arrangement of positioning satellites, the ionosphere, the troposphere, or the geographical features near a GNSS antenna. When the position measurement result varies, the construction surface may fluctuate in the excavation control and may not be constructed as a designed surface. Moreover, when the position measurement result varies, the cutting edge of the bucket 8 displayed on the guidance screen may fluctuate and the visibility of the operator may decrease. When the operating device 25 illustrated in FIG. 2 is a pilot pressure-type operating device, an oil gap may occur in the left operating lever 25L or the right operating lever 25R and the operator may feel a sense of incongruity.

The influence of a variation in the position measurement result obtained by the global coordinate calculating device 23 may be suppressed by performing a smoothing process such as low-pass filtering or moving average on the first reference position data P1 and P2 output from the global coordinate calculating device 23. In the excavator 100, the position of the GNSS antennas 21 and 22 also varies when the attitude angle during excavation varies. Thus, when the first reference position data P1 and P2 is directly subjected to the smoothing process, a delay associated with the smoothing process may occur in calculation of the position of the GNSS antennas 21 and 22 calculated by the smoothing process. As a result, the position of the GNSS antennas 21 and 22 calculated by the smoothing process may be different from the actual position of the GNSS antennas 21 and 22.

If a fixed point of which the absolute position does not change during the operation period of the excavator 100 is present in the excavator 100 and a relative relation between the position of the GNSS antennas 21 and 22 and the fixed point is known, the apparatus controller 39 of the control system 200 can calculate the absolute position of the fixed point from the position of the GNSS antennas 21 and 22. The apparatus controller 39 applies the smoothing process to the absolute position of the fixed point to obtain a fixed point in which a variation is suppressed. The apparatus controller 39 can suppress a variation in the RTK-GNSS positioning without being influenced by the delay associated with the smoothing process by calculating the position of the GNSS antennas 21 and 22 from the absolute position of the fixed point calculated by the smoothing process.

However, practically, since a vibration occurs due to the operation or the like of the work machine 2 as long as the engine 35 of the excavator 100 is operating, an approximate position which can be regarded as a fixed point is selected as a pseudo fixed point. The apparatus controller 39 of the control system 200 can back up the RTK-GNSS positioning using the pseudo fixed point by handling the selected pseudo fixed point in the same manner as the fixed point described above. The pseudo fixed point can be regarded as the fixed point when the excavator 100 does not move (that is, the crawler belts 5*a* and 5*b* illustrated in FIG. 1 do not move).

In the present embodiment, the control system 200 (more specifically, the apparatus controller 39 of the control system 200) applies a smoothing process to the pseudo fixed point described above to calculate the position of the GNSS antennas 21 and 22 (that is, the second position) using the pseudo fixed point calculated by the smoothing process. Since the pseudo fixed point can be regarded that the absolute position thereof does not change with time in the operation period of the excavator 100 as will be described later, the influence of a delay associated with the smoothing process can be ignored. As a result, the apparatus controller 39 can make the position of the GNSS antennas 21 and 22 calculated by the smoothing process identical to the actual position of the GNSS antennas 21 and 22. In this manner, the apparatus controller 39 can suppress the influence of a variation in the position measurement result obtained by the global coordinate calculating device 23 by applying a smoothing process to the pseudo fixed point. As a result, the apparatus controller 39 can suppress a decrease in the accuracy of the excavation control-based construction and a decrease in the visibility of the guidance screen.

The position information calculating unit 39B acquires the detection value STr (corresponding to the swing operation signal MR) of the pressure sensor 66 that detects the pilot pressure of the left operating lever 25L illustrated in FIG. 2 and the detection value STd (corresponding to the operation signal MD) of the pressure sensor 27PC that detects the pilot pressure of the travel levers 25FL and 25FR. The position information calculating unit 39B makes various determinations including whether or not to execute the smoothing process based on the acquired detection values STr and STd.

Next, the pseudo fixed point will be described. In the present embodiment, the pseudo fixed point is the position PL of the excavator 100 illustrated in FIGS. 3 and 4. Although the position PL is defined as the origin of the vehicle body coordinate system as described above, the origin of the vehicle body coordinate system may be defined at another position. Thus, in the following description, the pseudo fixed point is sometimes referred to as a specific point. When a movement that generates a rotation (hereinafter sometimes referred to as a swing) occurs in the excavator 100 in operation, the support point of the rotation does not move. Thus, if the pseudo fixed point is at the support point, the error in the position calculated by the control system 200 (for example, the position of a specific portion of the work machine 2 or the position of the work machine 2 including the position of the cutting edge 8T of the bucket 8) becomes the smallest. Even when it is difficult to set the pseudo fixed point at the support point of rotation, the error in the position (the position of the work machine 2) calculated by the control system 200 can be decreased by setting the pseudo fixed point to be as close as possible to the support point.

Since the support point when the upper swing structure 3 swings is the axis of the center of swing (that is, the z-axis), the pseudo fixed point is set on the z-axis. Although the support point of rotation in the direction of the roll angle θ4 and the direction of the pitch angle θ5 is not a fixed point, it is considered that the support point is always on the ground surface with which the excavator 100 makes contact. In the present embodiment, as described above, the position PL is the intersection between the z-axis which is the axis of the center of swing of the swing structure and the plane corresponding to the ground surface with which the traveling device 5 makes contact. In the present embodiment, by setting the pseudo fixed point on the ground surface with which the excavator 100 makes contact, it is considered that the pseudo fixed point is fixed even when a movement that generates a rotation occurs in the excavator 100 in operation. Thus, it is possible to suppress a variation in the position calculated by the control system 200 (specifically, the absolute position of the GNSS antennas 21 and 22) when a variation occurs in the RTK-GNSS positioning.

Although the excavator 100 can perform various operations, an operation for slope finishing construction is an example of a case in which the pseudo fixed point is fixed even when a rotation occurs in the excavator 100. In this case, the excavator 100 may perform excavation or leveling with the operation of the work machine 2 or the upper swing structure 3 only in a state in which the traveling device 5 stands still. When construction such as slope finishing construction is performed using the excavator 100 which enables the computer-aided construction, the control system 200 calculates the second position of the excavator 100 (specifically, the position of the GNSS antennas 21 and 22) using the pseudo fixed point and the position measurement result obtained by the RTK-GNSS. By doing so, the control system 200 can suppress a decrease in the accuracy of excavation control and a decrease in the visibility of the guidance screen.

<Pseudo Fixed Point Calculating Method>

A method by which the control system 200 (specifically, the apparatus controller 39) of the excavator 100 calculates the pseudo fixed point from the absolute position of the GNSS antennas 21 and 22 and calculates the absolute position of the GNSS antennas 21 and 22 from the pseudo fixed point will be described.

Equation (1) is an equation that converts a difference between a position vector of the position PL and a position vector of the GNSS antennas 21 and 22 in the vehicle body coordinate system to a difference between a position vector of the position PL and a position vector of the GNSS antennas 21 and 22 in the local coordinate system (X, Y, Z) illustrated in FIG. 3. Equation (2) is an equation that calculates a position vector Rfl of the position PL in the local coordinate system from a measurement value Ral of the position vector of the GNSS antennas 21 and 22 in the local coordinate system and is a modification of Equation (1). Equation (3) expresses the equation that calculates the measurement value Ral of the position vector of the GNSS antennas 21 and 22 in the local coordinate system from the position vector Rfl of the position PL in the local coordinate system as an equation that calculates a calculation value Ralc of the position vector of the GNSS antennas 21 and 22 in the local coordinate system.

$$Rfl-Ral=Clb(Rfb-Rab) \quad (1)$$

$$Rfl=Clb(Rfb-Rab)+Ral \quad (2)$$

$$Ralc=Clb(Rab-Rfb)+Rfl \quad (3)$$

Rfb: A calibration value of a position vector of the position PL in a vehicle body coordinate system Rab: A calibration value of a position vector of the GNSS antennas 21 and 22 in a vehicle body coordinate system Rfl: A calculation value of a position vector of the position PL in a local coordinate system Ral: A measurement value of a position vector of the GNSS antennas 21 and 22 in a local coordinate system Ralc: A calculation value of a position vector of the GNSS antennas 21 and 22 in a local coordinate system Clb: A coordinate rotation matrix from a vehicle body coordinate system to a local coordinate system The calibration values are the values of the position PL and the position of the GNSS antennas 21 and 22 obtained by measuring the respective positions and dimensions of the excavators 100 and are stored in at least one of the storage unit 39M of the apparatus controller 39 and the storage unit 28M of the display controller 28. The calibration values may be based on the design dimensions of the excavator 100, however, the design dimensions may vary from one excavator 100 to the other. Thus, the calibration values are preferably obtained based on measurement (calibration).

The coordinate rotation matrix Clb is expressed as Equation (4) using the roll angle θ4, the pitch angle θ5, and the yaw angle (that is, the azimuth angle θd). The roll angle θ4, the pitch angle θ5, and the azimuth angle θd can be calculated by the attitude angle calculating unit 39A time-integrating the x-axis angular velocity ωx, the y-axis angular velocity ωy, and the z-axis angular velocity ωz detected by the IMU 24. In Equation (4), sx is sin θ4, sy is sin θ5, sz is sin θd, cx is cos θ4, cy is cos θ5, and cz is cos θd.

$$Clb=\begin{bmatrix} cz\cdot cy & -sz\cdot cx+cz\cdot sy\cdot sx & sz\cdot sx+cz\cdot sy\cdot cx \\ sz\cdot cy & cz\cdot cx+sz\cdot sy\cdot sx & -cz\cdot sx+sz\cdot sy\cdot cx \\ -sy & cy\cdot sx & cy\cdot cx \end{bmatrix} \quad (4)$$

The control system 200 can calculate the position of the specific point (in the present embodiment, the position PL) which is the pseudo fixed point by using Equation (2). Moreover, the control system 200 can calculate the absolute position of the GNSS antennas 21 and 22 (that is, the position in the local coordinate system or the position in the global coordinate system) using the position of the specific point which is the pseudo fixed point by using Equation (3). The control system 200 can calculate the absolute position of the GNSS antennas 21 and 22 by using Equations (2) and (3).

<Smoothing Process>

In the present embodiment, the apparatus controller 39 applies a smoothing process to the position of the specific point which is the pseudo fixed point. In the present embodiment, the smoothing process uses a low-pass filter illustrated in Equation (5), for example.

$$Rft=\{(M-1)\times \mathrm{Rftpr}+Rfl\}/M \quad (5)$$

In Equation (5), Rft is the output of a low-pass filter in a present control cycle and Rftpr is the output of a low-pass filter (hereinafter appropriately referred to a filter) in a previous control cycle. These values are the position vectors of the specific point. M is an averaging constant. In the present embodiment, an initial value of the averaging constant M is 1 and M is increased by 1 whenever one control cycle ends until the value M reaches a setting value Mmax.

In the present embodiment, the apparatus controller 39 temporarily stores the filter output Rftpr in the previous control cycle in the storage unit 39M when the smoothing process starts. The storage unit 39M stores the filter output Rftpr in the previous control cycle until filtering of the next control cycle is executed or a smoothing process in execution is reset.

The apparatus controller 39 calculates the position vector Rfl indicating the position of the specific point using Equation (2) and gives the calculated position vector Rfl to Equation (5). The apparatus controller 39 applies a smoothing process (specifically, low-pass filtering) to the position vector Rfl of the specific point every control cycle according to Equation (5). After the low-pass filtering is performed, the apparatus controller 39 outputs the output Rft of the low-pass filter in the present control cycle as the position vector of the specific point obtained by the smoothing process. In the following description, the position vector of the specific point after the smoothing process will be appropriately referred to as a position vector Rft. The position vector Rft is the second reference position data P1*i* and P2*i*. The second reference position data P1*i* and P2*i* is information obtained by the smoothing process. In this manner, the apparatus controller 39 applies a smoothing process to the position of the specific point to calculate the second position using the position of the specific point obtained by the smoothing process by realizing the function of the low-pass filter illustrated in Equation (5).

The apparatus controller 39 sets the filter output Rftpr in the previous control cycle to Rfl in Equation (5) and sets the averaging constant M to 1 in a first round of the smoothing process or after the smoothing process is reset. The first round of smoothing process is a case in which the apparatus controller 39 does not have the filter output Rftpr in the previous control cycle when the apparatus controller 39 starts the smoothing process.

When the smoothing process is suspended due to some reasons, the apparatus controller 39 does not output the filter output Rft in the present control cycle but maintains the filter output Rftpr in the previous control cycle and the averaging constant M in the previous control cycle. In this case, the apparatus controller 39 stores the averaging constant M in the previous control cycle in addition to the filter output Rftpr in the previous control cycle in the storage unit 39M. When resuming the suspended smoothing process, the apparatus controller 39 gives the position vector Rfl of the specific point in the present control cycle and the filter output Rftpr and the averaging constant M before the suspension, stored in the storage unit 39M, to Equation (5). With this process, the apparatus controller 39 smoothes the position vector Rfl of the specific point.

In order to obviate an abnormal value in the position measurement result of the global coordinate calculating device 23, the apparatus controller 39 executes a determination process when the smoothing process starts (except when the first round of smoothing process starts) or when returning from the suspended smoothing process. When executing the determination process, the apparatus controller 39 calculates a difference ΔRfl using Equation (6). In Equation (6), Rfl is a position vector of the specific point in the present control cycle, and the Rftpr is the filter output stored in the storage unit 39M before the smoothing process starts or when returning from the suspended smoothing process (that is, resuming the smoothing process).

$$\Delta Rfl = |Rfl - \mathrm{Rftpr}| \tag{6}$$

In the determination process, when the difference ΔRfl is smaller than a predetermined threshold, the apparatus controller 39 determines that the position vector Rfl of the specific point in the present control cycle is normal and executes a smoothing process using the position vector Rfl of the specific point in the present control cycle. When the difference ΔRfl is equal to or larger than the predetermined threshold, the apparatus controller 39 determines that the position vector Rfl of the specific point in the present control cycle is abnormal. When the position vector is determined to be abnormal, the apparatus controller 39 calculates the filter output Rft in Equation (5) using the filter output Rftpr stored in the storage unit 39M instead of the position vector Rfl of the specific point in the present control cycle. With such a process, the apparatus controller 39 can suppress a variation in the cutting edge position of the bucket 8 resulting from the abnormal value when an abnormal value occurs in the position measurement result of the global coordinate calculating device 23. When a state in which the difference ΔRfl is equal to or larger than the predetermined threshold continues for a predetermined setting period Nt (in second), the apparatus controller 39 executes a timeout process. Specifically, the apparatus controller 39 resets the smoothing process.

Examples of a case in which an abnormal value occurs in the position measurement result of the global coordinate calculating device 23 include a case in which the coordinate value of the first reference position data P1 and P2 output by the global coordinate calculating device 23 has an abnormal value, a case in which an error occurs in the communication between the global coordinate calculating device 23 and the apparatus controller 39, a case in which a problem occurs in the RTK-GNSS positioning, and a case in which the above-described cases occur simultaneously. When the GNSS antennas 21 and 22 are unable to receive radio waves from positioning satellites or become difficult to receive radio waves, a problem occurs in the RTK-GNSS positioning.

In the present embodiment, the low-pass filter is not limited to that illustrated in Equation (5). The smoothing process is not limited to the low-pass filter and may be a process of calculating a moving average of the position of the specific point.

In the present embodiment, the apparatus controller 39 executes the smoothing process when the RTK-GNSS positioning is normal. When the apparatus controller 39 applies a smoothing process to the specific point, the attitude angle calculating unit 39A of the apparatus controller 39 calculates the roll angle θ4, the pitch angle θ5, and the azimuth angle θdc and outputs the angles to the position information calculating unit 39B and the cutting edge position calculating unit 28A of the display controller 28. Since the azimuth angle θdc (that is, the swing structure direction data Q) can be obtained from the reference position data P1 and P2 received by the global coordinate calculating device 23, the position of the work machine 2 obtained in the vehicle body coordinate system can be calculated as the position of the work machine 2 in the local coordinate system.

Figure 6:
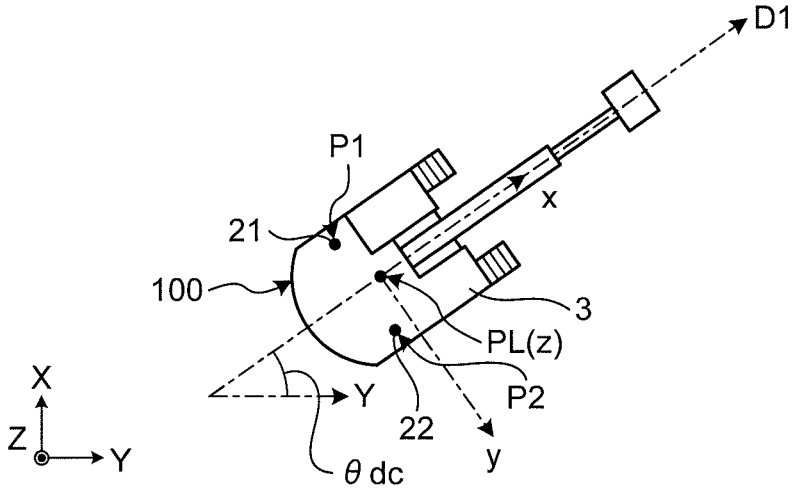
FIG. 6 is a plan view illustrating an attitude of an excavator.

FIG. 6 is a plan view illustrating the attitude of an excavator. The azimuth angle θdc calculated by the attitude angle calculating unit 39A indicates an inclination of the x-axis which is the axis in the front-rear direction of the upper swing structure 3 in relation to the Y-axis of the local coordinate system (X, Y, Z). A direction D1 of the excavator 100 is determined by the azimuth angle θdc.

The position information calculating unit 39B calculates a coordinate rotation matrix Clb from the roll angle θ4, the pitch angle θ5, and the azimuth angle θdc calculated by the attitude angle calculating unit 39A. In this case, the position information calculating unit 39B gives the azimuth angle θdc calculated by the attitude angle calculating unit 39A to θd in Equation (4) to calculate the coordinate rotation matrix Clb. Moreover, the position information calculating unit 39B calculates the measurement value Ral of the position vector of the GNSS antennas 21 and 22 in the local coordinate system from the reference position data P1 and P2 acquired from the global coordinate calculating device 23 in a state in which the RTK-GNSS positioning was normal. Moreover, the position information calculating unit 39B gives the calculated coordinate rotation matrix Clb and the calculated measurement value Ral of the position vector to Equation (2) to calculate the position vector Rfl of the position PL in the local coordinate system. The position vector Rfl is a calculation value.

When the position vector Rfl is obtained, the position information calculating unit 39B gives the position vector Rfl to Equation (5) to apply a smoothing process to the position vector Rfl. The position information calculating unit 39B gives the position vector Rfl obtained after the smoothing process (that is, the low-pass filter output Rft) to Rfl of Equation (3) to calculate the position vector of the GNSS antennas 21 and 22 (that is, the second reference position data P1*i* and P2*i*) in the local coordinate system. The position vector of the GNSS antennas 21 and 22 in the local coordinate system is the calculation value Ralc illustrated in Equation (3). The position information calculating unit 39B outputs the second reference position data P1*i* and P2*i* to the cutting edge position calculating unit 28A of the display controller 28 as the reference position data P1*c* and P2*c*.

Next, the work machine control unit 39C included in the processing unit 39P of the apparatus controller 39 will be described. The work machine control unit 39C generates a control signal N for controlling the velocity at which the work machine 2 approaches the target excavation landform data U based on the target excavation landform data U acquired from the display controller 28. The work machine control unit 39C gives the generated control signal N to the control valve 27 to open or close the control valve 27 to thereby control the velocity at which the work machine 2 approaches the target excavation landform data U.

Figure 7:
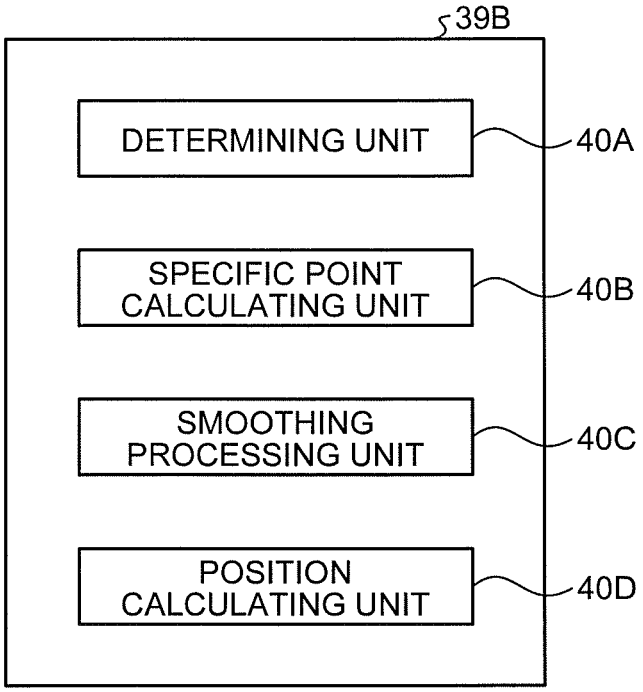
FIG. 7 is a diagram illustrating a position information calculating unit included in an apparatus controller according to the first embodiment.

FIG. 7 is a diagram illustrating the position information calculating unit 39B included in the apparatus controller 39 according to the first embodiment. The position information calculating unit 39B includes a determining unit 40A, a specific point calculating unit 40B, a smoothing processing unit 40C, and a position calculating unit 40D. The determining unit 40A determines whether the apparatus controller 39 is to execute or stop the smoothing process, suspend the smoothing process in execution, resume the suspended smoothing process, or reset the smoothing process. These determinations are performed based on the detection value STr of the pressure sensor 66 and the detection value STd of the pressure sensor 27PC.

The specific point calculating unit 40B calculates the position vector Rfl of the specific point using Equation (2). The smoothing processing unit 40C applies a smoothing process to the position vector Rfl of the specific point calculated by the specific point calculating unit 40B using Equation (5). The position calculating unit 40D gives the position vector Rft obtained after the smoothing process to Rfl of Equation (3) to calculate the second reference position data P1*i* and P2*i* and outputs these items of data to the display controller 28 as the reference position data P1*c* and P2*c*. Next, an example of a process in which the control system 200 according to the present embodiment executes a smoothing process to calculate the cutting edge position of the bucket 8 will be described.

<Example of Process of Control System 200>

Figure 8:
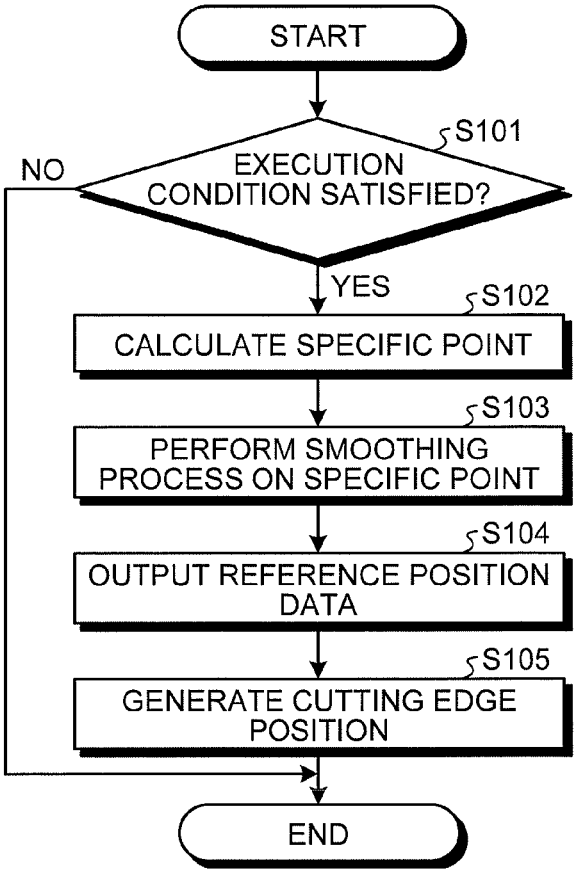
FIG. 8 is a flowchart illustrating an example of the process of the control system according to the first embodiment.

FIG. 8 is a flowchart illustrating an example of the process of the control system 200 according to the first embodiment. In step S101, the determining unit 40A of the position information calculating unit 39B included in the apparatus controller 39 of the control system 200 determines whether execution conditions necessary for the apparatus controller 39 to execute the smoothing process are satisfied. The execution conditions are satisfied when the RTK-GNSS positioning is normal, the excavator 100 is not traveling, and the upper swing structure 3 is not swinging.

When the starting conditions are satisfied (step S101: Yes), the apparatus controller 39 calculates the specific point in step S102. Specifically, the specific point calculating unit 40B of the position information calculating unit 39B included in the apparatus controller 39 calculate the specific point (specifically, the position vector Rfl of the specific point). In step S103, the apparatus controller 39 applies a smoothing process to the position vector Rfl of the specific point calculated by the specific point calculating unit 40B. In step S104, the position calculating unit 40D of the position information calculating unit 39B included in the apparatus controller 39 calculates the second reference position data P1*i* and P2*i* using the position vector Rft which is the position vector Rfl obtained after the smoothing process. Moreover, the position calculating unit 40D outputs the calculated second reference position data P1*i* and P2*i* to the display controller 28 as the reference position data P1*c* and P2*c*.

In step S105, the processing unit 28P of the display controller 28 calculates the cutting edge position which is the three-dimensional position of the cutting edge 8T of the bucket 8 using the position information IPL of the excavator 100 acquired from the apparatus controller 39. Specifically, the processing unit 28P generates the bucket cutting edge position data S indicating the cutting edge position. The position information IPL includes the reference position data P1*c* and P2*c*, the roll angle θ4, the pitch angle θ5, and the azimuth angle θdc. Subsequently, the description is continued by returning to step S101. When it is determined in step S101 that the starting conditions are not satisfied (step S101: No), the apparatus controller 39 ends the process. That is, the determining unit 40A determines that the execution conditions are not satisfied when at least one of the conditions that the RTK-GNSS positioning is normal, the excavator 100 is not traveling, and the upper swing structure 3 is not swinging is not satisfied. Next, a transition of a smoothing process state will be described.

<Transition of Smoothing Process State>

Figure 9:
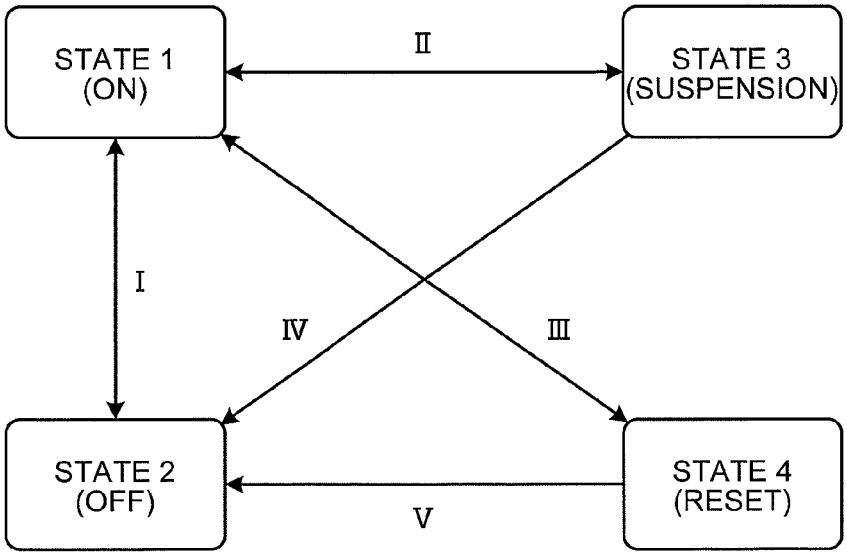
FIG. 9 is a diagram for describing the transition of a smoothing process state.

FIG. 9 is a diagram for describing a transition of the smoothing process state. In the present embodiment, the smoothing process transitions between four states of State 1 (ON, Execution of smoothing process), State 2 (OFF, Stopped smoothing process), State 3 (SUSPEND, Suspension of smoothing process in execution), and State 4 (RESET, Reset of smoothing process).

When the RTK-GNSS positioning is normal, the travel of the excavator 100 is stopped (Non-Traveling), and the upper swing structure 3 is not swinging, the apparatus controller 39 changes the smoothing process state to State 1. That is, State 1 is a smoothing process state when the above-described execution conditions are satisfied. In State 1, the apparatus controller 39 calculates the cutting edge position using the second reference position data P1*i* and P2*i* which is the second position information.

When the execution conditions are not satisfied (more specifically, when the excavator is traveling), the apparatus controller 39 causes the smoothing process to transition from State 1 to State 2 (I). That is, the apparatus controller 39 stops the process of calculating the second position (that is, the smoothing process) when the excavator 100 is traveling. In State 2, when the RTK-GNSS positioning is normal, the excavator 100 is not traveling, and the upper swing structure 3 is not swinging, the apparatus controller 39 causes the smoothing process to transition from State 2 to State 1 (I).

When the execution conditions are not satisfied in State 1 (more specifically, when at least one of the conditions that the RTK-GNSS positioning is abnormal and the upper swing structure 3 is swinging is satisfied), the apparatus controller 39 causes the smoothing process state to transition from State 1 to State 3 (II). In State 3, the apparatus controller 39 suspends the process of calculating the second reference position data P1*i* and P2*i* which is the second position information (that is, the smoothing process). In State 3, when the RTK-GNSS positioning is normal, the excavator 100 is not traveling, and the upper swing structure 3 is stopped (that is, is not swinging), the apparatus controller 39 causes the smoothing process to transition from State 3 to State 1 (II). In this case, the apparatus controller 39 resumes the suspended smoothing process. When resuming the suspended smoothing process, the apparatus controller 39 calculates the cutting edge position using the second reference position data P1*i* and P2*i* obtained before the smoothing process was suspended.

When executing a process of obviating an abnormal value in the position measurement result of the global coordinate calculating device 23 or a timeout process, the apparatus controller 39 causes the smoothing process to transition from State 1 to State 4 (III). In State 4, when the RTK-GNSS positioning is normal, the excavator 100 is not traveling, the upper swing structure 3 is not swinging, and the smoothing process is completely reset, the apparatus controller 39 causes the smoothing process to transition from State 4 to State 1 (III).

When the excavator 100 starts traveling during suspension of the smoothing process, the apparatus controller 39 causes the smoothing process to transition from State 3 to State 2 (IV). That is, the apparatus controller 39 stops the smoothing process which is the process of calculating the second position information. In State 4, when the excavator 100 is traveling, the upper swing structure 3 is swinging, or the RTK-GNSS positioning is abnormal, the apparatus controller 39 causes the smoothing process to transition from State 4 to State 2 (V).

<Determination of State of Excavator 100 and Positioning State of RTK-GNSS>

When the position information calculating unit 39B transitions the smoothing process state, the determining unit 40A of the position information calculating unit 39B illustrated in FIG. 7 determines the state of the excavator 100 and the positioning state of the RTK-GNSS. The determining unit 40A determines that the excavator 100 is traveling when the pressure sensor 27PC detects the pilot pressure of at least one of the travel lever 25FL and the travel lever 25FR. When the left operating lever 25L which is an operating lever for allowing the upper swing structure 3 to perform a swing operation is operated in either leftward or rightward direction, and the pressure sensor 66 detects the pilot pressure, the determining unit 40A determines that the upper swing structure 3 is swinging. When the state information SR generated by the global coordinate calculating device 23 indicates that the positioning state of the RTK-GNSS is abnormal, the determining unit 40A determines that the positioning state is abnormal.

<Process of Transitioning Smoothing Process State>

Figure 10:
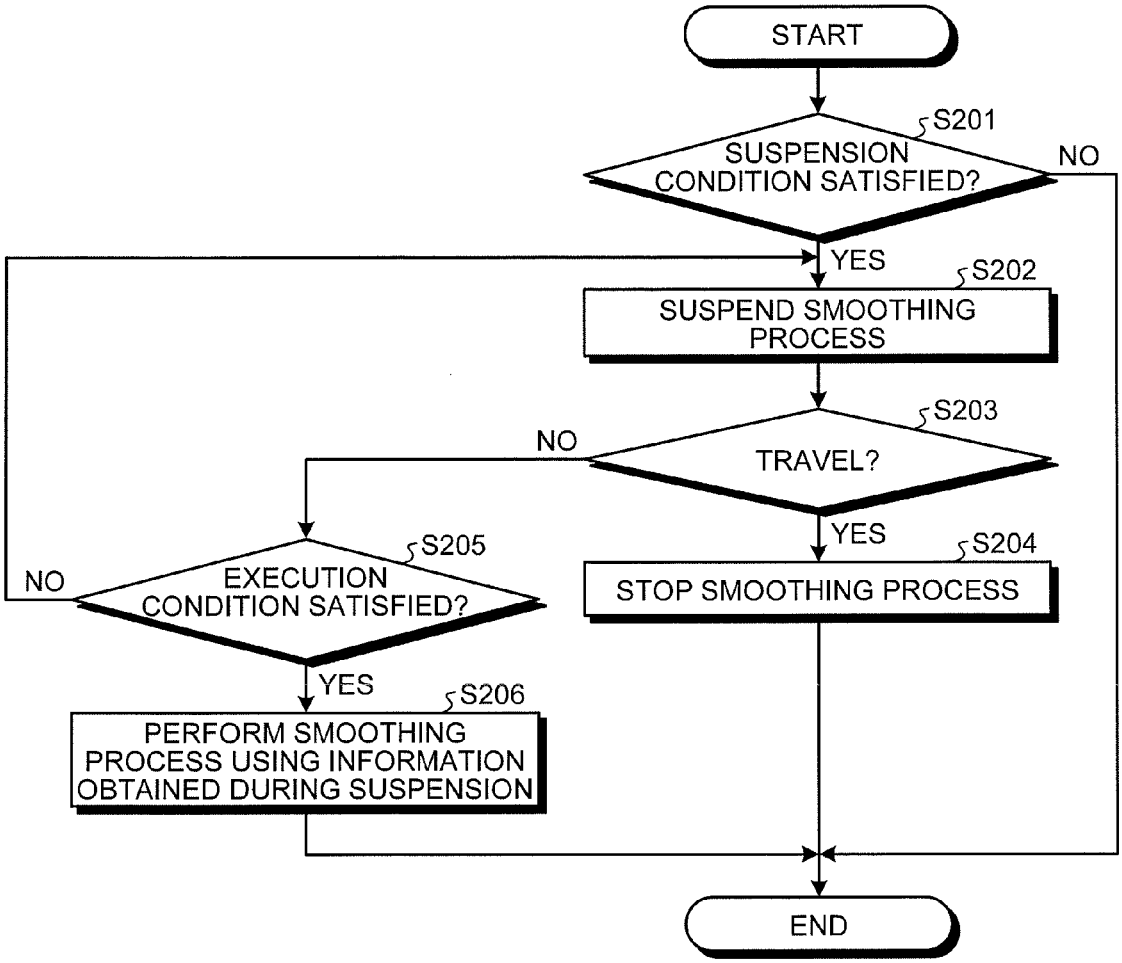
FIG. 10 is a flowchart of a process in which an apparatus controller transitions a smoothing process state and illustrates the process associated with suspension of the smoothing process in particular.

FIG. 10 is a flowchart of a process in which the apparatus controller 39 transitions the smoothing process state and illustrates a process associated with suspension of the smoothing process in particular. In step S201, when the apparatus controller 39 is executing the smoothing process, the determining unit 40A of the position information calculating unit 39B included in the apparatus controller 39 determines whether a condition for suspending the smoothing process is satisfied. The condition for suspending the smoothing process is satisfied when at least one of the conditions that the RTK-GNSS positioning is abnormal and the upper swing structure 3 is swinging is satisfied. When the determining unit 40A determines that the condition for suspending the smoothing process is satisfied (step S201: Yes), the position information calculating unit 39B of the apparatus controller 39 suspends the smoothing process in step S202 (II).

In step S203, the determining unit 40A determines whether the excavator 100 is traveling. When the determining unit 40A determines that the excavator 100 is traveling (step S203: Yes), the position information calculating unit 39B stops the suspended smoothing process in step S204 (IV). Subsequently, the description is continued by returning to step S201. When the determining unit 40A determines that the condition for suspending the smoothing process is not satisfied (step S201: No), the apparatus controller 39 ends the process.

Subsequently, the description is continued by returning to step S203. When the determining unit 40A determines that the excavator 100 is not traveling (step S203: No), the determining unit 40A determines whether the execution conditions are satisfied in step S205. When the determining unit 40A determines that the execution conditions are satisfied (step S205: Yes), the position information calculating unit 39B executes the smoothing process using the information obtained when the smoothing process was suspended in step S206 (II). The information obtained when the smoothing process was suspended includes the filter output Rftpr and the averaging constant M, stored in the storage unit 39M before the suspension. When the determining unit 40A determines that the execution conditions are not satisfied (step S205: No), the position information calculating unit 39B returns to step S202 and executes the processes subsequent to step S202.

Figure 11:
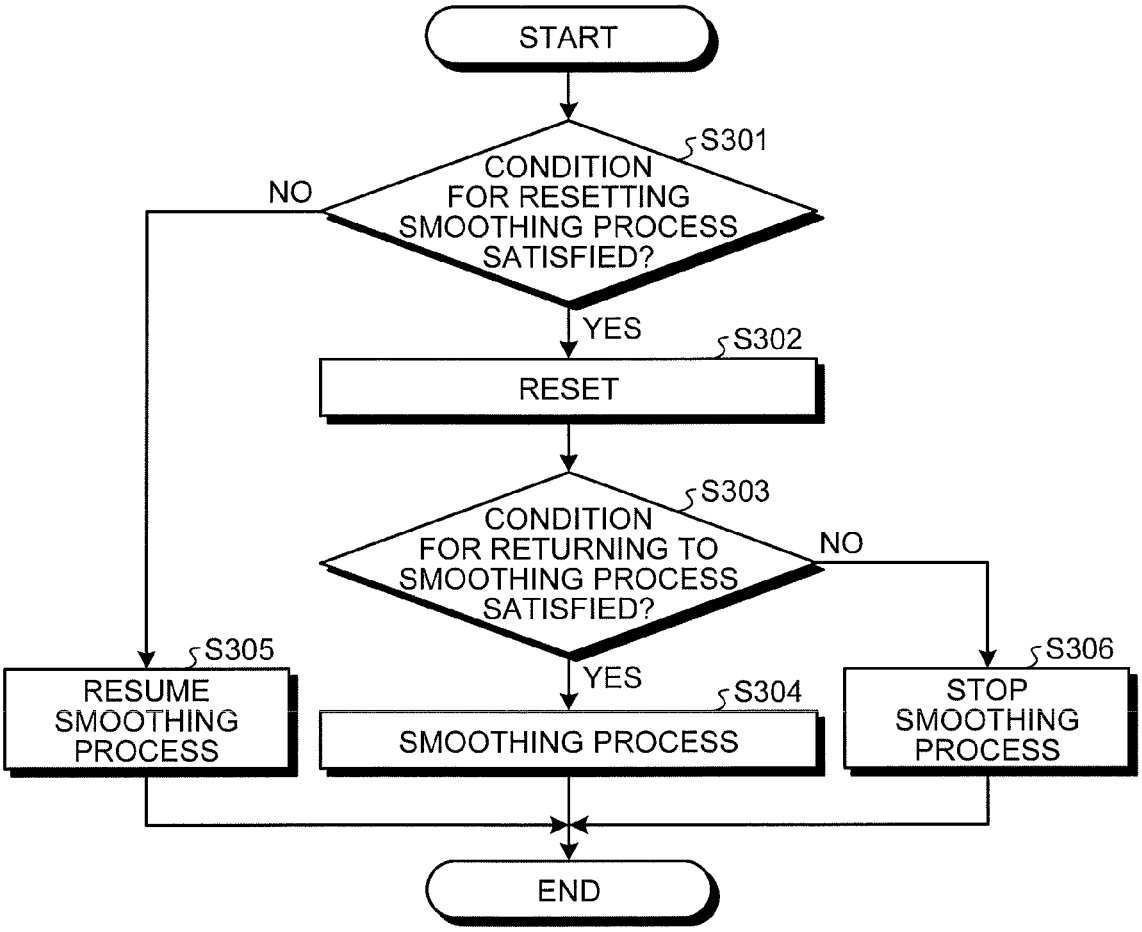
FIG. 11 is a flowchart of a process in which the apparatus controller transitions a smoothing process state and illustrates the process associated with resetting of the smoothing process in particular.

FIG. 11 is a flowchart of a process in which the apparatus controller 39 transitions the smoothing process state and illustrates the process associated with resetting of the smoothing process in particular. In step S301, when the apparatus controller 39 is executing the smoothing process, the determining unit 40A determines whether a condition for resetting the smoothing process is satisfied. The condition for resetting the smoothing process is satisfied when a timeout process is executed as a process of obviating an abnormal value in the position measurement result of the global coordinate calculating device 23 when a state in which an abnormal value occurs continues for a predetermined period (setting period: Nt seconds). When the determining unit 40A determines that the condition for resetting the smoothing process is satisfied (step S301: Yes), the position information calculating unit 39B of the apparatus controller 39 resets the smoothing process in step S302 (III).

In step S303, the determining unit 40A determines whether a condition for returning to the smoothing process is satisfied. The condition for returning to the smoothing process is satisfied when the smoothing process state is State 4, the RTK-GNSS positioning is normal, the excavator 100 is not traveling, the upper swing structure 3 is not swinging, and the smoothing process is completely reset. When the determining unit 40A determines that the condition for returning to the smoothing process is satisfied (step S303: Yes), the position information calculating unit 39B executes the smoothing process in step S304 (III).

Subsequently, the description is continued by returning to step S301. When the determining unit 40A determines that the condition for resetting the smoothing process is not satisfied (step S301: No), the position information calculating unit 39B continues the smoothing process in execution in step S305. Subsequently, the description is continued by returning to step S303. When the determining unit 40A determines that the condition for returning to the smoothing process is not satisfied (step S303: No), the smoothing process is stopped in step S306 (V).

In the present embodiment, the second position corresponding to the position of a partial portion of the excavator 100 is calculated using the first position information (that is, the first reference position data P1 and P2) from the global coordinate calculating device 23 and the operation information MI from the IMU 24 and the position of at least a partial portion of the work machine 2 is calculated using the obtained second position information. In the present embodiment, the second position is calculated using the first reference position data P1 and P2 and the information on the specific point obtained from the IMU 24 (that is, the intersection between the z-axis which is the axis of the center of swing of the upper swing structure 3 and the plane corresponding to the ground surface with which the traveling device 5 makes contact). The specific point can be regarded that the absolute position thereof does not change with time during the operation of the excavator 100. Thus, even when the apparatus controller 39 applies the smoothing process to the position of the specific point and calculates the second position using the position of the specific point obtained after the smoothing process, it is possible to ignore the influence of the delay associated with the smoothing process. As a result, in the present embodiment, since the second position can be made identical to the position of a partial portion of the excavator 100, it is possible to reduce the influence on the computer-aided construction, of a variation in the position measurement result, in a construction machine that performs the computer-aided construction based on the position measurement result of the construction machine. As an example, it is possible to suppress a decrease in the accuracy of excavation control-based construction and a decrease in the visibility of the guidance screen.

While the first embodiment has been described, the configuration of the first embodiment can be appropriately applied to the following embodiments.

Second Embodiment

Figure 12:
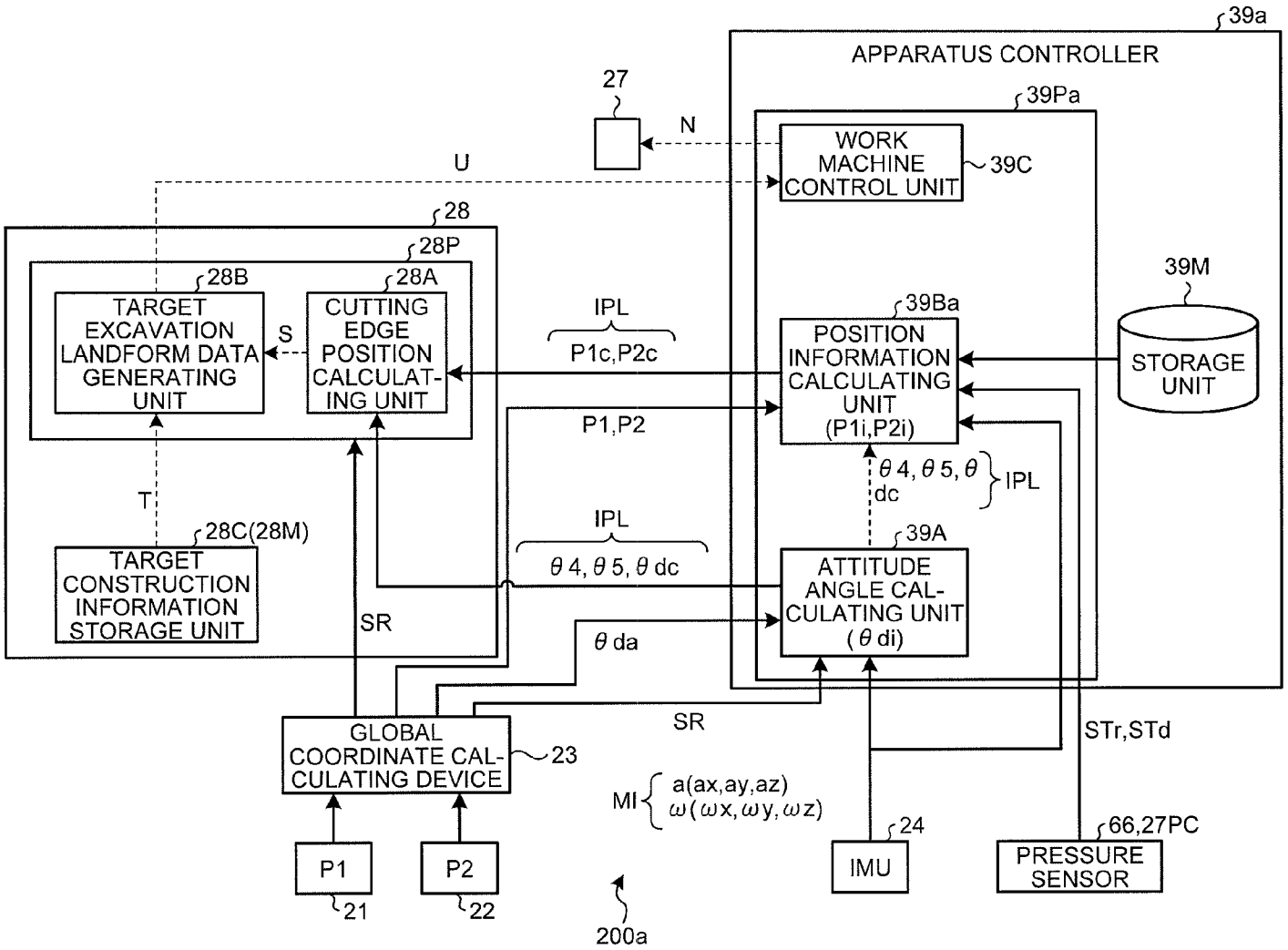
FIG. 12 is a control block diagram of a control system according to a second embodiment.
Figure 13:
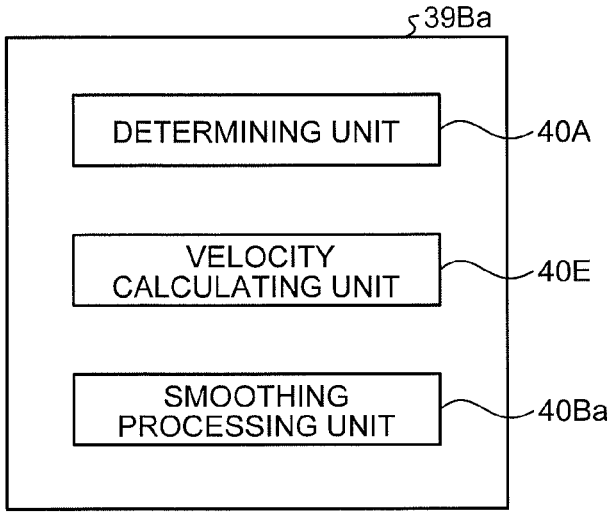
FIG. 13 is a diagram illustrating a position information calculating unit included in an apparatus controller according to the second embodiment.

FIG. 12 is a control block diagram of a control system 200*a* according to a second embodiment. FIG. 13 is a diagram illustrating a position information calculating unit 39Ba included in an apparatus controller 39*a* according to the second embodiment. The control system 200*a* is the same as the control system 200 of the first embodiment except that the operation information MI which is the detection value of the IMU 24 is input to the position information calculating unit 39Ba included in a processing unit 39Pa of the apparatus controller 39*a* and the position information calculating unit 39Ba has a different configuration from that of the position information calculating unit 39B according to the first embodiment. The apparatus controller 39*a* is realized by a processor such as a CPU and a storage device such as a RAM and a ROM similarly to the first embodiment. The function of the processing unit 39Pa of the apparatus controller 39*a* is realized when the processing unit 39Pa reads a computer program for realizing the function from the storage unit 39M and executes the computer program.

The position information calculating unit 39Ba includes the determining unit 40A, a velocity calculating unit 40E, and a smoothing processing unit 40Ba. The determining unit 40A is the same as the determining unit 40A of the apparatus controller 39 according to the first embodiment and the description thereof will not be provided. The velocity calculating unit 40E calculates velocity v generated in the GNSS antennas 21 and 22 from the angular velocity ω which is the operation information MI acquired from the IMU 24 and a relative positional relation between the IMU 24 and the GNSS antennas 21 and 22. That is, a certain angular velocity ω is generated when a movement occurs in the vehicle body 1 and the GNSS antennas 21 and 22 installed in the same vehicle body 1 as the IMU 24 move. A relative positional relation (for example, a design dimension) between the IMU 24 and the GNSS antennas 21 and 22 is known. Thus, since the movement (moving distance) of the GNSS antennas 21 and 22 is calculated from the angular velocity ω and the relative positional relation, the distance that the GNSS antennas 21 and 22 have moved in a predetermined period (that is, the velocity v) is calculated. Time dt is one control cycle.

<Smoothing Process>

In the present embodiment, the apparatus controller 39*a* (more specifically, the smoothing processing unit 40Ba) applies a smoothing process to the first position (more specifically, the reference position data P1 and P2 which is the first position information) using the velocity v. In the present embodiment, the smoothing process uses a low-pass filter illustrated in Equation (7).

$$P_i=\{P+(M-1)\times(P_{i-1}+vdt)\}/M \tag{7}$$

In Equation (7), P is the first reference position data P1 and P2 which is the first position information in a present control cycle. $P_{i-1}$ is the low-pass filter output in the previous control cycle (that is, the first reference position data P1 and P2 which is the first position information to which the smoothing process is applied in the previous control cycle. The first reference position data P1 and P2 is output by the global coordinate calculating device 23. In Equation (7), $P_i$ is the low-pass filter output in the present control cycle and is the second reference position data P1*i* and P2*i* which is the second position information. In Equation (7), v is the velocity of the GNSS antennas 21 and 22 calculated by the velocity calculating unit 40E from the angular velocity ω detected by the IMU 24 and the relative positional relation between the IMU 24 and the GNSS antennas 21 and 22. In Equation (7), dt is one control cycle of the apparatus controller 39*a*. vdt is the distance that the excavator 100 has moved in one control cycle of the apparatus controller 39*a*. M is an averaging constant. The averaging constant M is the same as that of the first embodiment. The smoothing processing unit 40Ba of the apparatus controller 39*a* applies a smoothing process to the first position using the operation information MI to calculate the second position by realizing the function of the low-pass filter illustrated in Equation (7).

In the present embodiment, the velocity calculating unit 40E included in the position information calculating unit 39Ba of the apparatus controller 39*a* calculates the velocity v every control cycle and the smoothing processing unit 40Ba applies a smoothing process to the first reference position data P1 and P2 every control cycle using the velocity v. The velocity v is calculated from the angular velocity ω which is the detection value of the IMU 24 and the relative positional relation between the IMU 24 and the GNSS antennas 21 and 22. The position information calculating unit 39Ba of the apparatus controller 39*a* applies a smoothing process to the first reference position data P1 and P2 output from the global coordinate calculating device 23 using the detection value of the IMU 24. In this manner, the position information calculating unit 39Ba applies the smoothing process using the detection value of the IMU 24. Thus, the position information calculating unit 39Ba can calculate the second reference position data P1*i* and P2*i* by reflecting the influence on the change in the position of the GNSS antennas 21 and 22, of an attitudinal change, of the excavator 100 during excavation, with the detection value of the IMU 24. As a result, since the apparatus controller 39*a* can suppress the influence of a variation in the position measurement result of the global coordinate calculating device 23, it is possible to suppress a decrease in the accuracy of the excavation control-based construction and a decrease in the visibility of the guidance screen.

<Example of Process of Control System 200*a*>

Figure 14:
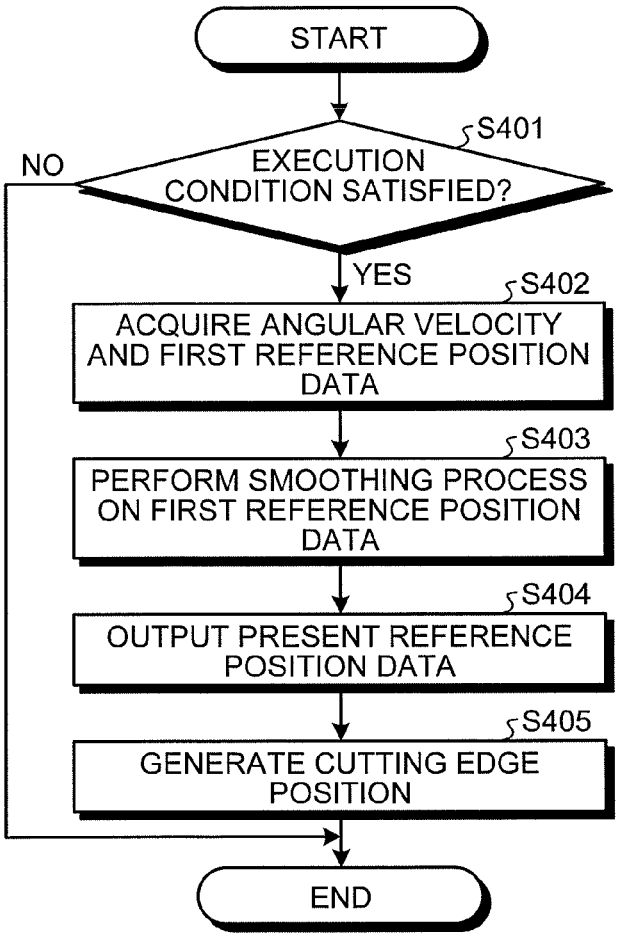
FIG. 14 is a flowchart illustrating an example of the process of the control system according to the second embodiment.

FIG. 14 is a flowchart illustrating an example of the process of the control system 200*a* according to the second embodiment. In step S401, the determining unit 40A of the position information calculating unit 39Ba included in the apparatus controller 39*a* of the control system 200*a* determines whether the execution conditions necessary for the apparatus controller 39*a* to execute a smoothing process are satisfied. The execution conditions are the same as those described in the first embodiment.

When the starting conditions are satisfied (step S401: Yes), the apparatus controller 39*a* acquires the angular velocity ω from the IMU 24 and acquires the first reference position data P1 and P2 from the global coordinate calculating device 23 in step S402. In step S403, the smoothing processing unit 40Ba included in the position information calculating unit 39Ba of the apparatus controller 39*a* applies a smoothing process to the first reference position data P1 and P2 using the velocity v. The velocity v is calculated by the velocity calculating unit 40E from the angular velocity ω and the relative positional relation between the IMU 24 and the GNSS antennas 21 and 22. The relative positional relation between the IMU 24 and the GNSS antennas 21 and 22 is preferably obtained based on measurement (calibration) as a calibration value.

In step S404, the smoothing processing unit 40Ba included in the apparatus controller 39*a* outputs the filter output (that is, the second reference position data P1*i* and P2*i*) to the display controller 28 as the reference position data P1*c* and P2*c*. In step S405, the processing unit 28P of the display controller 28 calculates the cutting edge position which is the three-dimensional position of the cutting edge 8T of the bucket 8 using the position information IPL of the excavator 100 acquired from the apparatus controller 39. Subsequently, the description is continued by returning to step S401. When it is determined in step S401 that the starting conditions are not satisfied (step S401: No), the apparatus controller 39*a* ends the process. In the present embodiment, the process of transitioning the smoothing process state is the same as that of the first embodiment.

In the present embodiment, the second position is calculated using the first reference position data P1 and P2 and the operation information MI from the IMU 24 and the position of at least a partial portion of the work machine 2 is calculated using the obtained second position information. In the first embodiment, the second position is calculated using the first reference position data P1 and P2 and the information on the specific point obtained from the IMU 24. However, in the present embodiment, the velocity is calculated from the operation information MI (more specifically, an angular velocity or the like) detected by the IMU 24, and a smoothing process is applied to the first reference position data P1 and P2 which is the first position information using the obtained velocity to calculate the second position. In the present embodiment, it is possible to calculate the second position by reflecting the influence on the change in the position of the GNSS antennas 21 and 22, of an attitudinal change of the excavator 100 during excavation, with the detection value of the IMU 24 (specifically, the angular velocity). As a result, in the present embodiment, it is possible to suppress the influence on the computer-aided construction, of a variation in the position measurement result of the global coordinate calculating device 23.

While the second embodiment has been described, the configuration of the second embodiment can be appropriately applied to the following embodiment.

Third Embodiment

Figure 15:
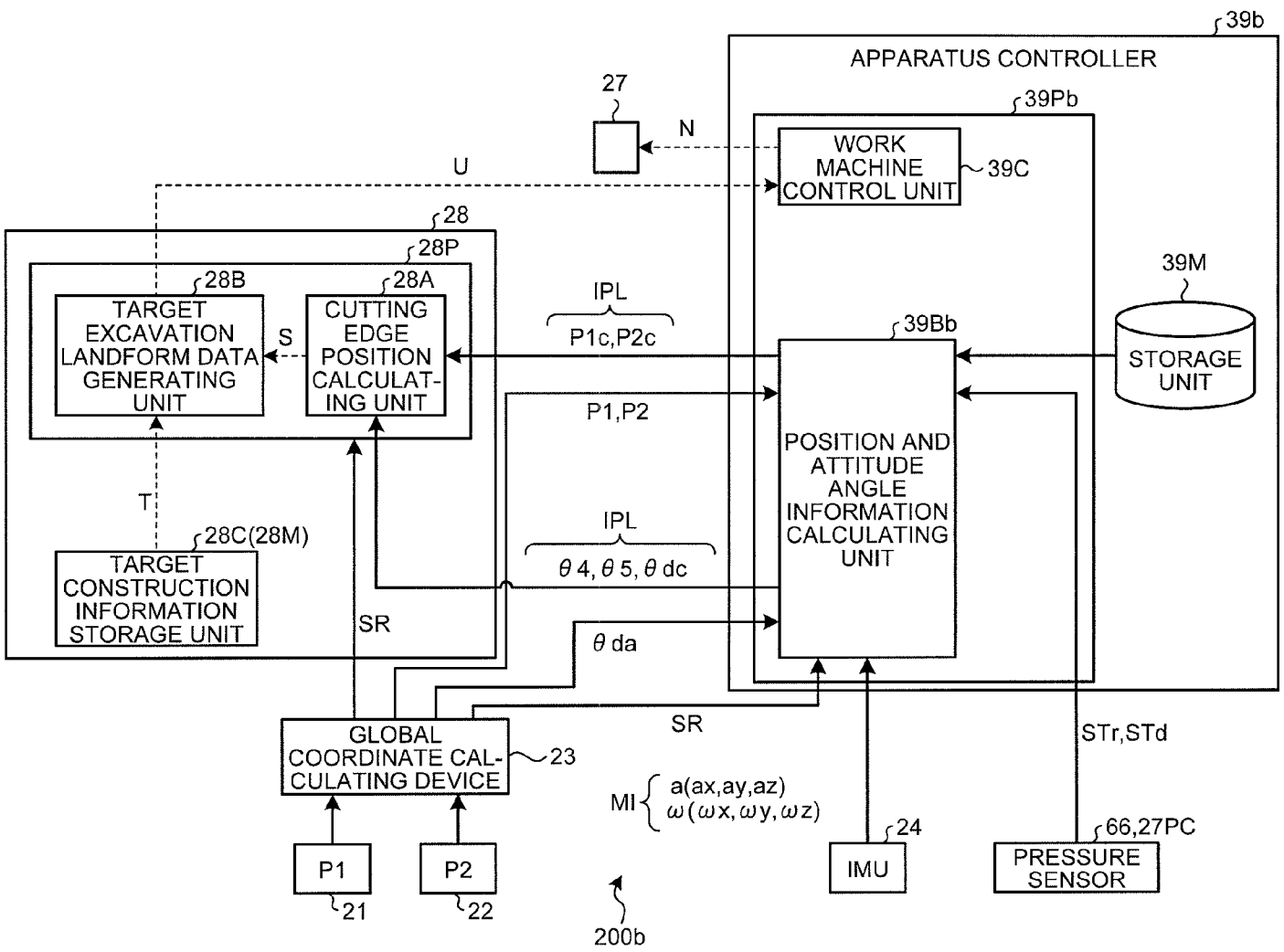
FIG. 15 is a control block diagram of a control system according to a third embodiment.
Figure 16:
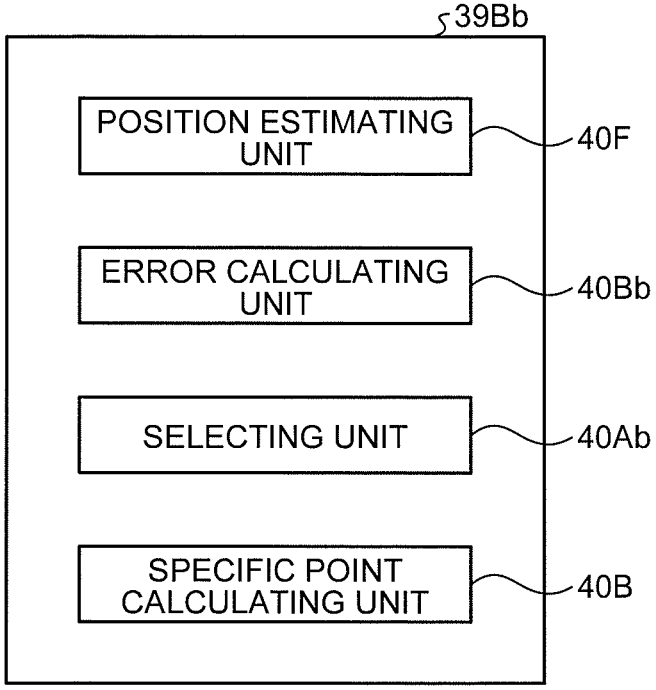
FIG. 16 is a diagram illustrating a position and attitude information calculating unit included in an apparatus controller according to the third embodiment.

FIG. 15 is a control block diagram of a control system 200*b* according to a third embodiment. FIG. 16 is a diagram illustrating a position and attitude information calculating unit 39Bb included in an apparatus controller 39*b* according to the third embodiment. In the third embodiment, a Kalman filter is used in a position and attitude calculation method. The control system 200*b* is the same as the control system 200 of the first embodiment except that the control system 200*b* includes the position and attitude information calculating unit 39Bb and the operation information MI which is the detection value of the IMU 24 is input to the position and attitude information calculating unit 39Bb included in a processing unit 39Pb of the apparatus controller 39*b*. The apparatus controller 39*b* is realized by a processor such as a CPU and a storage device such as a RAM and a ROM similarly to the first embodiment. The function of the processing unit 39Pb of the apparatus controller 39*b* is realized when the processing unit 39Pb reads a computer program for realizing the function from the storage unit 39M and executes the computer program.

The position and attitude information calculating unit 39Bb includes a position estimating unit 40F, an error calculating unit 40Bb, a selecting unit 40Ab, and the specific point calculating unit 40B. The position estimating unit 40F estimates a position and attitude estimation value such as the position, velocity, azimuth angle, and attitude angle of the excavator 100 using the operation information MI detected by the IMU 24. The position of the excavator 100 is the position of the GNSS antennas 21 and 22. In the present embodiment, the position estimating unit 40F uses inertial navigation when estimating the position and attitude value such as the position, velocity, azimuth angle, and attitude angle of the excavator 100 to calculate the position and attitude estimation value. The position estimating unit 40F outputs the position of the excavator 100 obtained by estimation as the second position (specifically, the second reference position data P1*i* and P2*i*). Moreover, the position estimating unit 40F corrects the second position using an error output by the error calculating unit 40Bb.

The error calculating unit 40Bb calculates the position, velocity, azimuth angle, and attitude angle of the excavator 100 or an error included therein estimated by the position estimating unit 40F using at least one of the first reference position data P1 and P2 and velocity V, the azimuth angle θda, the specific point (in the present embodiment, the position PL), and the angular velocity ω (=0) during stopping of the excavator 100 as an observation value and outputs the error to the position estimating unit 40F. That is, the error calculating unit 40Bb transmits information for correcting the position and attitude estimation value to the position estimating unit 40F. The position estimating unit 40F corrects an error in the position and attitude estimation value calculated previously using the information for correcting the position and attitude estimation value. After that, the position estimating unit 40F calculates the second position data from the corrected position and attitude estimation value. The first reference position data P1 and P2 and the velocity V and the azimuth angle θda of the excavator 100 among the observation values used by the error calculating unit 40Bb are obtained from the global coordinate calculating device 23. The error calculating unit 40Bb converts the first reference position data P1 and P2 and the velocity V in the global coordinate system obtained from the global coordinate calculating device 23 to the corresponding values in the local coordinate system. The specific point (in the present embodiment, the position PL) and the position vector Rfl of the specific point are calculated by the specific point calculating unit 40B. In the present embodiment, the error calculating unit 40Bb includes a Kalman filter.

The selecting unit 40Ab selects an observation value to be used by the error calculating unit 40Bb according to the state of the excavator 100. The state of the excavator 100 includes a stationary state, a non-stationary state, a swing state of the upper swing structure 3, and a travel state of the excavator 100.

Figure 17:
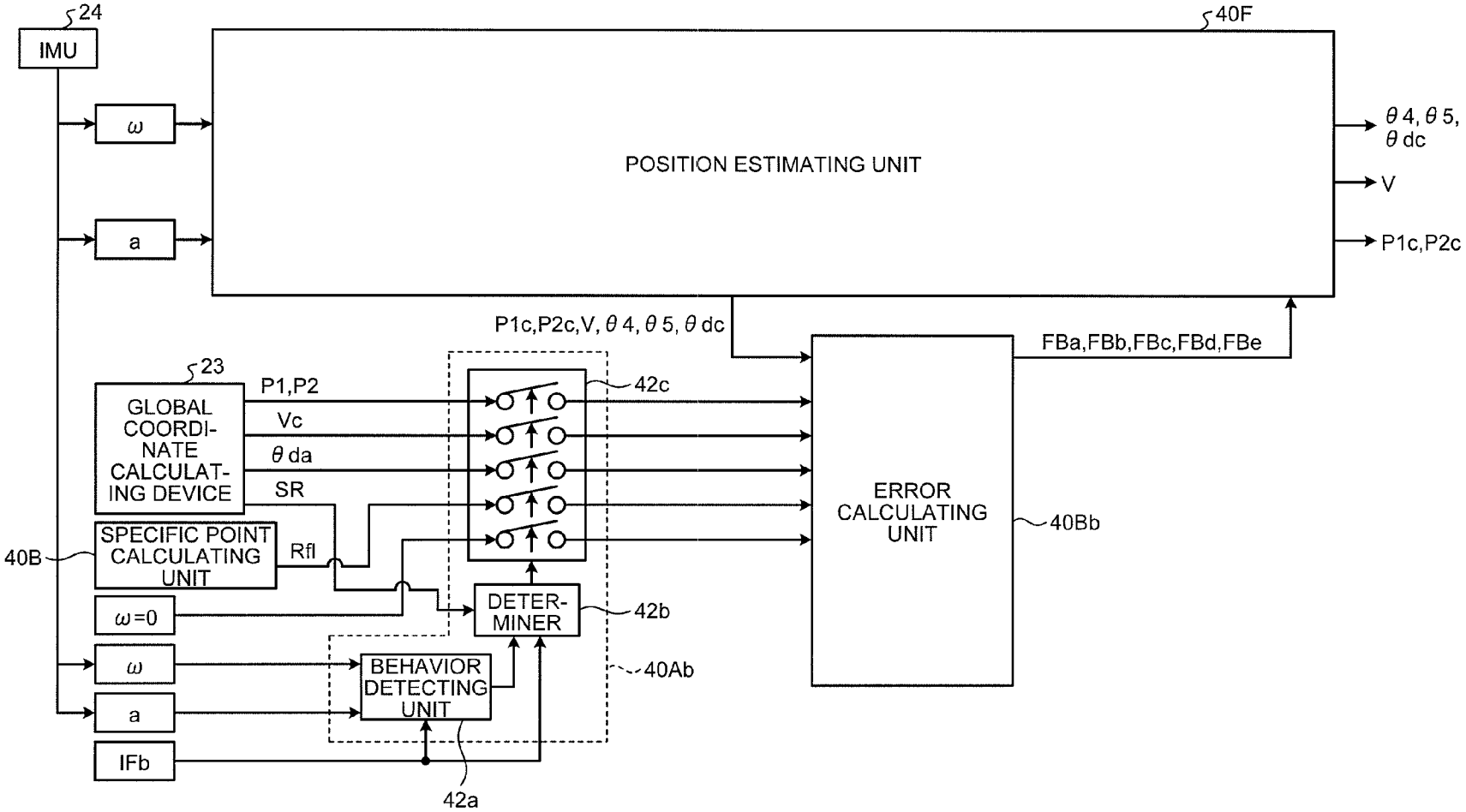
FIG. 17 is a control block diagram of the position and attitude information calculating unit included in the apparatus controller according to the third embodiment.

FIG. 17 is a control block diagram of the position and attitude information calculating unit 39Bb included in the apparatus controller 39*b* according to the third embodiment. The position estimating unit 40F integrates the angular velocity measured by the IMU 24 to calculate an estimated attitude angle value and an estimated azimuth angle of the vehicle body. The position estimating unit 40F integrates the acceleration measured by the IMU 24 to calculate an estimated velocity and an estimated position of the excavator 100.

The selecting unit 40Ab includes a behavior detecting unit 42*a*, a determiner 42*b*, and a selector 42*c*. The behavior detecting unit 42*a* receives vehicle body information IFb and the angular velocity ω and the acceleration a which are the detection values of the IMU 24. In the present embodiment, the vehicle body information IFb includes the detection value STr of the pressure sensor 66 that detects the pilot pressure of the left operating lever 25L and the right operating lever 25R illustrated in FIG. 2 and the detection value STd of the pressure sensor 27PC that detects the pilot pressure of the travel lever 25FL and the travel lever 25FR. The behavior detecting unit 42*a* detects the state of the excavator 100 using the angular velocity ω, the acceleration a, and the vehicle body information IFb and outputs a signal corresponding to the detection result to the determiner 42*b*.

The determiner 42*b* receives the signal from the behavior detecting unit 42*a*, the vehicle body information IFb, and the state information SR output by the global coordinate calculating device 23. The determiner 42*b* operates the selector 42*c* based on the input information and selects an observation value to be input to the error calculating unit 40Bb. The selector 42*c* receives observation values, that is, the first reference position data P1 and P2 received by the global coordinate calculating device 23, the velocity Vc and the azimuth angle θda of the excavator 100, the position vector Rfl of the specific point calculated by the specific point calculating unit 40B, and the angular velocity ω (=0) when the excavator 100 is not swinging. The global coordinate calculating device 23 calculates the first reference position data P1 and P2 and calculates the velocity Vc of the excavator 100 using the radio waves (signals) from positioning satellites. The azimuth angle θda is calculated by the global coordinate calculating device 23 from the first reference position data P1 and P2.

The error calculating unit 40Bb receives the observation value corresponding to the state of the excavator 100 from the selector 42*c* of the selecting unit 40Ab. The error calculating unit 40Bb includes a Kalman filter. The error calculating unit 40Bb acquires an observation vector, corrects a state vector predicted in advance by a state equation, and calculates a post-estimation value. By repeatedly performing this process, a more probable estimation value is calculated. Equation (8) is a calculation formula of the Kalman filter. $X_{k|k}$ (X: bold font) is a state vector obtained by post estimation, $X_{k|k-1}$ (X: bold font) is a state vector obtained by prior estimation, K (K: bold font) is a Kalman gain, $z_k$ (z: bold font) is an observation vector, and $H_k$ (H: bold font) is an observation matrix. The error calculating unit 40Bb calculates the state vector obtained by post estimation using Equation (8).

$$X_{k|k}=X_{k|k-1}+K(z_k-H_kX_{k|k-1}) \tag{8}$$

A Kalman gain K (K: bold font) is calculated by Equation (9). $P_{k|k-1}$ (P: bold font) is a covariance of an estimation error, and $R_k$ (R: bold font) is a covariance of an observation error. By setting the covariance $P_{k|k-1}$ of the estimation error and the covariance $R_k$ of the observation error, the weighting factors of the state vector $X_{k|k}$ (X: bold font) and the observation vector $z_k$ (z: bold font) are determined.

$$K=P_{k|k-1}H_k^T(H_kP_{k|k-1}H_k^T+R_k)^{-1} \tag{9}$$

A state vector will be described. When prediction values are represented in normal fonts and correction values are represented in italic fonts, an error state vector is defined by Equations (10) to (14). Here, $\delta\psi^n_{nb}$ (ψ: bold font): An angular error vector [rad] of the excavator 100 in a navigation coordinate system δωb (ωb: bold font): An angular velocity bias error vector [rad/s] of the IMU 24

$\delta P^1_{lb}$ (P: bold font): A position error vector [m] of the origin of a vehicle body coordinate in a local coordinate system about the local coordinate system $\delta V^n_{eb}$ (V: bold font): A velocity error vector [m/s] of the origin of a vehicle body coordinate in a local coordinate system about an earth centered earth fixed (ECEF) coordinate system δAb (Ab: bold font): An acceleration bias error vector [m/s$^2$] of the IMU 24

$C_b^n$ (C: bold font): A coordinate rotation matrix from a vehicle body coordinate system to a navigation coordinate system $\psi^n_{nb}$ (ω: bold font): An angle vector [rad] of the excavator 100 in a navigation coordinate system ωb (ωb: bold font): An angular velocity vector [rad/s] of the IMU 24

Ab (Ab: bold font): An acceleration vector [m/s$^2$] of the IMU 24

$P^l_{lb}$ (P: bold font): A position vector [m] of the origin of a vehicle body coordinate in a local coordinate system about the local coordinate system $V^n_{eb}$ (V: bold font): A velocity vector [m/s] of the origin of a vehicle body coordinate in a local coordinate system about an ECEF coordinate system I: A unit matrix $$\delta C_b^n=C_b^nC_b^{nT}=I+[\delta\psi^n_{nb}\hat{}] \tag{10}$$

$$\delta\omega b=\omega b-\omega b \tag{11}$$

$$\delta P^l_{lb}=P^l_{lb}-P^l_{lb} \tag{12}$$

$$\delta V^n_{eb}=V^n_{eb}-V^n_{eb} \tag{13}$$

$$\delta Ab=Ab-Ab \tag{14}$$

A state equation will be described. Equations (11) to (19) are state equations based on an error state model. Noise terms are omitted. Here, $\omega^n_{ie}$ (ω: bold font): An earth rotation velocity vector [rad/s] in a navigation coordinate system $A^n_{ib}$ (A: bold font): An acceleration vector [m/s$^2$] of the origin of a vehicle body coordinate in a navigation coordinate system about an inertial coordinate system.

$$(\delta\psi^n_{nb})/(dt)=-[\omega^n_{ie}\hat{}](\delta\psi^n_{nb})-C_b^n(\delta\omega b) \tag{15}$$

$$(\delta\omega b)/(dt)=0 \tag{16}$$

$$(\delta P^l_{lb})(dt)=(\delta V^l_{lb})=(\delta V^n_{eb}) \tag{17}$$

$$(\delta V^n_{eb})/(dt)=-[A^n_{ib}\hat{}](\delta\psi^n_{nb})-2[\omega^n_{ie}\hat{}](\delta V^n_{eb})-C_b^n(\delta Ab) \tag{18}$$

$$(\delta Ab)/(dt)=0 \tag{19}$$

Observation equations of the observation values represented in italic fonts are illustrated in Equations (20) to (24). Noise terms are omitted. Equation (20) is an observation equation of the position of the GNSS antennas 21 and 22, and Equation (21) is an observation equation of the velocity of the GNSS antennas 21 and 22. Equation (22) is an observation equation of the velocity of the specific point, which is used in the stopped and swinging states of the excavator 100. Equation (23) is an observation equation of an acceleration of the excavator 100 in the stopped state. Equation (23) is an observation equation of the azimuth angle based on the GPS compass in the non-swinging state of the excavator 100.

$P^l_{la}$ (italic font): The position [m] of the GNSS antennas 21 and 22 in a local coordinate system about the local coordinate system $V^n_{ea}$ (italic font): The velocity [m/s] of the GNSS antennas 21 and 22 in a navigation coordinate system about an ECEF coordinate system $V^n_{eq}$ (italic font): The velocity [m/s] of the specific point in a navigation coordinate system about an ECEF coordinate system $\psi_z$ (italic font): A measured azimuth angle [rad] of the excavator 100 based on a GPS compass $\delta C_b^{nT}$: A rotation matrix ($\delta C_b^{nT}=I-[\delta\psi^n_{nb}\hat{}]$) of an attitude angle error $\delta\psi_z$: An azimuth angle error (Z component of $\delta\psi^n_{nb}$) [rad] of the excavator 100

$R^b_{ba}$: The position [m] of the GNSS antennas 21 and 22 in a vehicle body coordinate system about the vehicle body coordinate system $R^b_{bq}$: The position [m] of the specific point in a vehicle body coordinate system about the vehicle body coordinate system $\omega^b_{nb}$: An angular velocity vector [rad/s] of a vehicle body coordinate system in a vehicle body coordinate system about a navigation coordinate system $\psi_z$: An azimuth angle [rad] of the excavator 100 based on inertial navigation calculation $$P^l_{la}=(P^l_{lb}-\delta P^l_{lb})+(\delta C_b^{nT})C_b^n R^b_{ba} \tag{20}$$

$$V^n_{ea}=(V^n_{eb}-\delta V^n_{eb})+(\delta C_b^{nT})C_b^n(\omega^b_{nb}+\delta\omega b)\times R^b_{ba} \tag{21}$$

$$V^n_{eq}(=0)=(V^n_{eb}-\delta V^n_{eb})+(\delta C_b^{nT})C_b^n(\omega^b_{nb}+\delta\omega b)\times R^b_{bq} \tag{22}$$

$$\omega^b_{nb}(=0)=\omega^b_{nb}+\delta\omega b \tag{23}$$

$$\psi_z=\psi_z-\delta\psi_z \tag{24}$$

$[\delta\psi^n_{nb}\hat{}]$ (ψ: bold font) in Equation (10), $[\omega^n_{ie}\hat{}]$ (ω: bold font) in Equations (15) and (18), and $[A^n_{ib}]$ (A: bold font) in Equation (18), mentioned earlier, will be described. It is assumed that $\delta\psi^n_{nb}$ (ψ: bold font), $\omega^n_{ie}$ (ω: bold font), and $A^n_{ib}$ (A: bold font) are the vectors in a three-dimensional coordinate system of (α, β, γ) or the vectors of the rolling, pitching, and yawing directions. The rolling direction is the direction about the α-axis, the pitching direction is the direction about the β-axis, and the yawing direction is the direction about the γ-axis. In this case, $[\delta\psi^n_{nb}\hat{}]$ (ψ: bold font) is represented by Equation (25), $[\omega^n_{ie}\hat{}]$ (ω: bold font) is represented by Equation (26), and $[A^n_{ib}]$ (A: bold font) is represented by Equation (27). $\delta\psi_\alpha$, $\delta\psi_\beta$, and $\delta\psi_\gamma$ are the angular errors of the excavator 100 about the α, β, and γ-axes in that order. $\omega i_\alpha$, $\omega i_\beta$, and $\omega i_\gamma$ are the earth rotation velocity components about the α, β, and γ-axes in that order. $Ai_\alpha$, $Ai_\beta$, and $Ai_\gamma$ are the acceleration components of the origin of the vehicle body coordinate of the excavator 100 about the α, β, and γ-axes in that order.

$$[\delta\Psi^n_{nb}\hat{}]=\begin{bmatrix}0, & -\delta\Psi_r, & \Psi_\beta\\ \Psi_r, & 0, & -\Psi_\alpha\\ -\Psi_\beta, & \Psi_\alpha, & 0\end{bmatrix} \tag{25}$$

$$[\omega^n_{ie}\hat{}]=\begin{bmatrix}0, & -\omega i_r, & \omega i_\beta\\ \omega i_r, & 0, & -\omega i_\alpha\\ -\omega i_\beta, & \omega i_\alpha, & 0\end{bmatrix} \tag{26}$$

$$[A^n_{ib}\hat{}]=\begin{bmatrix}0, & -Ai_r, & Ai_\beta\\ Ai_r, & 0, & -Ai_\alpha\\ -Ai_\beta, & Ai_\alpha, & 0\end{bmatrix} \tag{27}$$

In prior estimation, the error calculating unit 40Bb can calculate the prior estimation value (that is, the state vector $X_{k|k-1}$) of the state vector illustrated in Equations (10) to (14) by solving the state equations illustrated in Equations (15) to (19). In the present embodiment, the state vector includes an angle vector $\psi^n_{nb}$ (ψ: bold font) of the excavator 100 in a navigation coordinate system, an angular velocity vector ωb (ωb: bold font) of the IMU 24, an acceleration vector Ab (Ab: bold font) of the IMU 24, a position vector $P^l_{lb}$ (P: bold font) of the origin of a vehicle body coordinate in a local coordinate system about the local coordinate system, and a velocity vector $\delta V^l_{eb}$ (V: bold font) of the origin of a vehicle body coordinate in a local coordinate system about an ECEF coordinate system. When calculating the state vector $X_{k|k-1}$ based on prior estimation, the error calculating unit 40Bb acquires the attitude angle (the roll angle θ4, the pitch angle θ5, and the azimuth angle θdc) calculated by the position estimating unit 40F, the second reference position data P1*i* and P2*i*, and the velocity V and uses the same as the predicted values of the position, velocity, and attitude.

The observation matrix is obtained by the Jacobian of an observation equation. The error calculating unit 40Bb calculates the observation vector $z_k$ (z: bold font) using Equations (20) to (24) and calculates the Kalman gain K (K: bold font) from Equation (9). Moreover, the error calculating unit 40Bb can calculate the state vector $X_{k|k}$ which is a post estimation value by giving the state vector $X_{k|k-1}$ obtained by prior estimation, the observation vector $z_k$ (z: bold font), and the Kalman gain K (K: bold font) to Equation (8) and solving the equation.

The vector of the angular velocity bias error FBa is an angular velocity bias error vector δωb (ωb: bold font) of the IMU 24. The vector of the vehicle body angle error FBb is an angular error vector $\delta\psi^n_{nb}$ (ψ: bold font) of the excavator 100 in a navigation coordinate system. The vector of the vehicle body velocity error FBc is a velocity error vector $\delta V^l_{eb}$ (V: bold font) of the origin of a vehicle body coordinate in a local coordinate system about an ECEF coordinate system. The vector of the vehicle body position error FBd is a position error vector $\delta P^l_{lb}$ (P: bold font) of the origin of the vehicle body coordinate in a local coordinate system about the local coordinate system. The vector of the acceleration bias error FBe is an acceleration bias error vector δAb (Ab: bold font) of the IMU 24.

As described above, the state vector $X_{k|k}$ obtained by post estimation corresponds to the angular velocity bias error FBa, the vehicle body angle error FBb, the vehicle body velocity error FBc, the vehicle body position error FBd, and the acceleration bias error FBe. The error calculating unit 40Bb outputs the state vector $X_{k|k}$ calculated based on post estimation to the position estimating unit 40F. The position estimating unit 40F corrects the position and attitude estimation value using the state vector $X_{k|k}$ obtained from the error calculating unit 40Bb. More specifically, the position estimating unit 40F corrects the error included in the position and attitude estimation value (corrects the position and attitude estimation value) using the state vector $X_{k|k}$. The position obtained by the position estimating unit 40F correcting the position and attitude estimation value (estimated position) using the state vector $X_{k|k}$ is the second position of the excavator 100. In this manner, the position estimating unit 40F estimates the position of the excavator using the operation information and corrects the obtained estimated position using the state vector $X_{k|k}$ to thereby calculate the second position of the excavator.

Figures 18, 19:
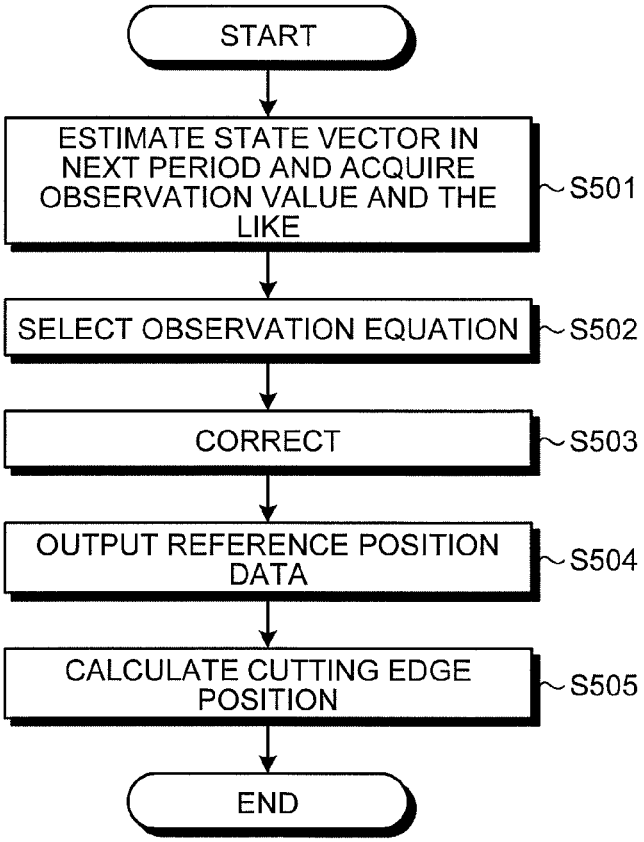
FIG. 18 is a diagram illustrating an example of a table in which information used when an error calculating unit selects an observation equation to be used is described.
FIG. 19 is a flowchart illustrating an example of the process of the control system according to the third embodiment.

FIG. 18 is a diagram illustrating an example of a table 44 in which information used when the error calculating unit 40Bb selects the observation equation to be used is described. The table 44 is stored in the storage unit 39M of the apparatus controller 39*b* illustrated in FIG. 15. In the present embodiment, the observation value that the error calculating unit 40Bb uses when estimating the state vector $X_{k|k}$ is selected according to the state of the excavator 100. Thus, the observation equation used by the error calculating unit 40Bb is different depending on the observation value used by the error calculating unit 40Bb. When estimating the state vector $X_{k|k}$, the error calculating unit 40Bb selects an observation equation corresponding to the observation value selected according to the state of the excavator 100 from Equations (20) to (24).

As illustrated in FIG. 18, the state of the excavator 100 is determined according to a combination of the positioning state (that is, State A, State B, and State C) of the RTK-GNSS and the operation state (that is, Stationary 1, Stationary 2, and Traveling indicating the state of the vehicle body) of the excavator 100. The positioning state of the RTK-GNSS is a detection state of the position of the excavator 100 by the global coordinate calculating device 23. In the present embodiment, since three positioning states and three vehicle body states are used, the state of the excavator 100 includes nine states in total. The details of the content of the positioning state and the operation state will be described below. In the present embodiment, the number and the content of the positioning states and the operation states are not limited to the below.

State A: The positioning state is Fix

State B: The positioning state is other than Fix and No Solution

State C: The positioning state is No Solution

Stationary 1: The excavator 100 is stopped and the upper swing structure 3 is also stopped Stationary 2: The excavator 100 is stopped and the upper swing structure 3 is swinging Traveling: The excavator is traveling The determiner 42*b* of the selecting unit 40Ab determines an operation state based on the signal from the behavior detecting unit 42*a* and the vehicle body information IFb and determines the positioning state based on the state information SR output by the global coordinate calculating device 23. The determiner 42*b* determines an observation value to be input to the error calculating unit 40Bb from the observation equation used by the error calculating unit 40Bb based on the operation condition and the positioning condition described in the table 44 stored in the storage unit 39M. Moreover, the determiner 42*b* operates the selector 42*c* so that the determined observation value is input to the error calculating unit 40Bb.

When the observation equation of Equation (20) is used, the determiner 42*b* determines the first reference position data P1 and P2 corresponding to the position of the GNSS antennas 21 and 22 received by the global coordinate calculating device 23 as an observation value to be input to the error calculating unit 40Bb. When the observation equation of Equation (21) is used, the determiner 42*b* converts the first reference position data P1 and P2 corresponding to the position of the GNSS antennas 21 and 22 received by the global coordinate calculating device 23 and the velocity Va of the GNSS antennas 21 and 22 calculated by the global coordinate calculating device 23 to the corresponding values in the local coordinate system and determines the converted values as the observation values to be input to the error calculating unit 40Bb. When the observation equation of Equation (22) is used, the determiner 42*b* determines the position vector Rfl of the specific point calculated by the specific point calculating unit 40B illustrated in FIG. 16 as the observation value to be input to the error calculating unit 40Bb. When the observation equation of Equation (23) is used, the determiner 42*b* determines the angular velocity in a stopped state (that is, the angular velocity $\omega$ (=0) when the excavator 100 is stopped) as the observation value to be input to the error calculating unit 40Bb. When the observation equation of Equation (24) is used, the determiner 42*b* determines the azimuth angle $\theta$da of the excavator 100 based on the GPS compass, calculated by the global coordinate calculating device 23, as the observation value to be input to the error calculating unit 40Bb.

The error calculating unit 40Bb calculates the observation vector $z_k$ (z: bold font) using the observation equation corresponding to the observation value input from the selector 42*c*. In this manner, since the error calculating unit 40Bb changes the observation equation to be used when calculating the observation vector $z_k$ (z: bold font) according to the state of the excavator 100 (that is, the positioning state and the vehicle body state), it is possible to reduce the number of observation equations depending on the state of the excavator 100. As a result, the error calculating unit 40Bb can reduce the calculation burden.

When the excavator 100 is stopped and the upper swing structure 3 is not swinging, the error calculating unit 40Bb can calculate the observation vector $z_k$ (z: bold font) using the observation value that the velocity of the specific point of the excavator 100 is 0 and the angular velocity $\omega$ is 0. As a result, it is possible to suppress the influence of a variation in the position measurement result of the global coordinate calculating device 23.

FIG. 19 is a flowchart illustrating an example of the process of the control system 200*b* according to the third embodiment. In step S501, the position and attitude information calculating unit 39Bb of the apparatus controller 39*b* estimates the state vector of the excavator 100 in the next period (in the present embodiment, the next control cycle) and acquires an observation value.

In step S502, the error calculating unit 40Bb of the position and attitude information calculating unit 39Bb selects an observation equation to be used when calculating the observation vector $z_k$ (z: bold font) according to the positioning state and the vehicle body state. In step S503, the error calculating unit 40Bb calculates the state vector $X_{k|k}$ which is a post estimation value and outputs the angular velocity bias error FBa, the vehicle body angle error FBb, the vehicle body velocity error FBc, the vehicle body position error FBd, and the acceleration bias error FBe corresponding to the state vector to the position estimating unit 40F. The position estimating unit 40F corrects the angular velocity $\omega$ and the acceleration a detected by the IMU 24, the angle that the position estimating unit 40F has calculated from the angular velocity $\omega$, and the velocity and position that the position estimating unit 40F has calculated from the acceleration a using the angular velocity bias error FBa, the vehicle body angle error FBb, the vehicle body velocity error FBc, the vehicle body position error FBd, and the acceleration bias error FBe acquired from the error calculating unit 40Bb.

In step S504, the position and attitude information calculating unit 39Bb outputs the second reference position data P1*i* and P2*i* obtained by the correction described above to the cutting edge position calculating unit 28A of the display controller 28 as the reference position data P1*c* and P2*c*. In step S505, the processing unit 28P of the display controller 28 calculates the cutting edge position which is the three-dimensional position of the cutting edge 8T of the bucket 8 using the position information IPL of the excavator 100 acquired from the apparatus controller 39.

In the present embodiment, the second position is calculated using the first reference position data P1 and P2 which is the first position information and the operation information MI from the IMU 24, and the position of at least a partial portion of the work machine 2 is calculated using the obtained second position information. In the first embodiment, the second position is calculated using the first reference position data P1 and P2 and the information on the specific point obtained from the IMU 24. In the present embodiment, by adding a condition that the specific point (the pseudo fixed point) stands still to the observation equation, it is possible to calculate the second position similarly to the first embodiment.

In the present embodiment, the position of the excavator 100 is estimated by inertial navigation, and the error included in the position and attitude error of the excavator 100 and the error of the IMU 24 are calculated by the Kalman filter. In the present embodiment, the position of the excavator 100 in the next period is estimated by inertial navigation, and the estimated position of the excavator 100 is corrected based on the error calculated by the Kalman filter using the first position information and the operation information MI. In the first and second embodiments, the position information obtained by the global coordinate calculating device 23 is subjected to the smoothing process. However, in the present embodiment, the position estimated in advance by inertial navigation is corrected using an error calculated by the Kalman filter, or the state vector estimated in advance by inertial navigation is corrected using a state vector calculated by the Kalman filter. Thus, in the present embodiment, it is possible to eliminate the influence of a delay associated with the smoothing process. Therefore, it is possible to more reliably reduce the influence on the computer-aided construction, of a variation in the position measurement result, in a construction machine that performs the computer-aided construction based on the position measurement result of the construction machine.

While the first to third embodiments have been described, the first to third embodiments are not limited to the contents described above. Moreover, the constituent elements disclosed in the embodiments include those easily conceivable by a person of ordinary skill in the art and those substantially equivalent thereto, that is, those within the range of equivalence. Further, the constituent elements can be appropriately combined with each other.

Further, at least one of various omissions, substitutions, and changes may be made in the constituent elements without departing from the spirit of the first to third embodiments. For example, the respective processes executed by the apparatus controller 39 may be executed by the apparatus controller 39, the display controller 28, a pump controller, or another controller. The construction machine is not limited to the excavator 100 and may be another construction machine such as a wheel loader or a bulldozer. The attitude angle calculating unit 39A and the position and attitude information calculating unit 39B illustrated in FIG. 5 are provided in the apparatus controller 39. However, any one or both may be provided in the display controller 28 and may be provided in a controller other than the display controller 28.

REFERENCE SIGNS LIST

1 VEHICLE BODY
2 WORK MACHINE
3 UPPER SWING STRUCTURE
5 TRAVELING DEVICE
8 BUCKET
8B TOOTH
8T CUTTING EDGE
21, 22 ANTENNA (GNSS ANTENNA)
23 GLOBAL COORDINATE CALCULATING DEVICE
25 OPERATING DEVICE
28 DISPLAY CONTROLLER
28A CUTTING EDGE POSITION CALCULATING UNIT
28B TARGET EXCAVATION LANDFORM DATA GENERATING UNIT
28C TARGET CONSTRUCTION INFORMATION STORAGE UNIT
28M STORAGE UNIT
28P PROCESSING UNIT
39, 39*a*, 39*b* APPARATUS CONTROLLER
39A ATTITUDE ANGLE CALCULATING UNIT
39B, 39Ba POSITION INFORMATION CALCULATING UNIT
39Bb POSITION AND ATTITUDE INFORMATION CALCULATING UNIT
39C WORK MACHINE CONTROL UNIT
39M STORAGE UNIT
39P, 39Pa, 39Pb PROCESSING UNIT
40A DETERMINING UNIT
40Ab SELECTING UNIT
40B SPECIFIC POINT CALCULATING UNIT
40Ba, 40C SMOOTHING PROCESSING UNIT
40D POSITION CALCULATING UNIT
40E VELOCITY CALCULATING UNIT
40F POSITION ESTIMATING UNIT
40Bb ERROR CALCULATING UNIT
41*a*, 41*g*, 41*p* VEHICLE BODY COORDINATE SYSTEM CONVERTING UNIT
41*b*, 41*c*, 41*h*, 41*j* ADDER/SUBTRACTOR
41*d*, 41*f* UPDATING UNIT
41*i* LOCAL COORDINATE SYSTEM CONVERTING UNIT
41*k* VELOCITY CORRECTING UNIT
41*m* INTEGRATOR
41*n* POSITION CORRECTING UNIT
42*a* BEHAVIOR DETECTING UNIT
42*b* DETERMINER
42*c* SELECTOR
44 TABLE
60 REFERENCE POST
100 EXCAVATOR
200, 200*a*, 200*b* CONTROL SYSTEM
FBa ANGULAR VELOCITY BIAS ERROR
FBb VEHICLE BODY ANGLE ERROR
FBc VEHICLE BODY VELOCITY ERROR

FBd VEHICLE BODY POSITION ERROR
FBe ACCELERATION BIAS ERROR
K KALMAN GAIN
M AVERAGING CONSTANT
MI OPERATION INFORMATION
P, P1*c*, P2*c* REFERENCE POSITION DATA
P1, P2 FIRST REFERENCE POSITION DATA
P1*i*, P2*i* SECOND REFERENCE POSITION DATA
SR STATE INFORMATION
a ACCELERATION
g GRAVITATIONAL ACCELERATION
ω ANGULAR VELOCITY
θ4 ROLL ANGLE
θ5 PITCH ANGLE
θda, θdc, θdi AZIMUTH ANGLE

The invention claimed is:

1. A construction machine control system that controls a construction machine including a traveling device, a work machine having a working tool, and a swing structure to which the work machine is attached, the swing structure being attached to the traveling device to swing, the system comprising:

a position detection device that detects a first position which is a position of a partial portion of the construction machine and outputs the first position as first position information;

a state detection device that detects and outputs operation information indicating an operation of the construction machine; and a processing device that calculates a second position corresponding to the position of the partial portion using the first position information and the operation information and calculates a position of at least a partial portion of the work machine using information of the second position.

2. The construction machine control system according to claim 1, wherein the processing device calculates the second position using a position of a specific point which is an intersection between an axis of a center of swing of the swing structure and a plane corresponding to a ground surface with which the traveling device makes contact, which is information obtained from the first position and the operation information.

3. The construction machine control system according to claim 2, wherein the processing device applies a smoothing process to the position of the specific point and calculates the information of the second position using the position of the specific point obtained after the smoothing process.

4. The construction machine control system according to claim 1, wherein the processing device applies a smoothing process to the first position using the operation information to calculate the information of the second position.

5. The construction machine control system according to claim 2, wherein the processing device calculates the position of at least a partial portion of the work machine using the information of the second position when the position of the construction machine detected by the position detection device is normal, the travel of the construction machine is stopped, and the swing structure is not swinging.

6. A construction machine control method of controlling a construction machine including a traveling device, a work machine having a working tool, and a swing structure to which the work machine is attached, the swing structure being attached to the traveling device to swing, the method comprising:

calculating a second position of the construction machine corresponding to a position of a partial portion of the construction machine using a first position which is the position of the partial portion of the construction machine detected by a position detection device included in the construction machine and operation information of the construction machine detected by a state detection device included in the construction machine; and calculating a position of at least a partial portion of the work machine using the second position.

* * * * *